US005149904A

United States Patent [19]

Kamiya et al.

[11] Patent Number: 5,149,904

[45] Date of Patent: Sep. 22, 1992

[54] PITCH DATA OUTPUT APPARATUS FOR ELECTRONIC MUSICAL INSTRUMENT HAVING MOVABLE MEMBERS FOR VARYING INSTRUMENT PITCH

[75] Inventors: Yukio Kamiya, Kiyose; Touru Watanabe, Fussa; Ryutaroh Hayashi, Tachikawa, all of Japan

[73] Assignee: Casio Computer Co., Ltd., Tokyo, Japan

[21] Appl. No.: 473,349

[22] Filed: Feb. 1, 1990

[30] Foreign Application Priority Data

Feb. 7, 1989 [JP] Japan ..... 1-13170[U]
Mar. 10, 1989 [JP] Japan ..... 1-58300

[51] Int. Cl.[5] ..... G10H 3/00

[52] U.S. Cl. ..... 84/723; 84/395; 84/626; 84/735; 84/743

[58] Field of Search ..... 84/600, 644, 647, 662, 84/670, 690, 718, 723-725, 734, 735, 743, 395, 604, 626

[56] References Cited

U.S. PATENT DOCUMENTS 3,456,062 7/1969 Watson et al. ..... 84/723
3,767,833 10/1973 Noble et al. ..... 84/673
4,085,646 4/1978 Naumann ..... 84/633
4,342,244 8/1982 Perkins ..... 84/723 X
4,385,541 5/1983 Muller et al. ..... 84/658
4,527,456 7/1985 Perkins et al. ..... 84/723 X
4,546,245 10/1985 Cooper et al. ..... 84/DIG. 19 X
4,635,516 1/1987 Giannini ..... 84/600
4,723,468 2/1988 Takabayashi et al. ..... 84/723 X
4,794,838 1/1989 Corrigan ..... 84/600
4,915,008 4/1990 Sakashita ..... 84/735 X
5,069,106 12/1991 Sakashita ..... 84/626

FOREIGN PATENT DOCUMENTS 0264782 10/1987 European Pat. Off. .

*Primary Examiner*—William M. Shoop, Jr.
*Assistant Examiner*—Jeffrey W. Donels
*Attorney, Agent, or Firm*—Frishauf, Holtz, Goodman & Woodward

[57] ABSTRACT

An apparatus for outputting a pitch data corresponding to a relative distance between a pair of movable members or a position of a second movable member relative to a first movable member. Data indicating the output relative distance or data indicating the output relative position is converted to corresponding pitch data in accordance with one of a plurality of conversion characteristics selected by a selection section. A pitch corresponding to the converted pitch data is determined. An electronic musical instrument outputs a musical tone having the determined pitch. The musical tone is controlled in accordance with a flow state of air passing through a mouthpiece or a bite pressure.

11 Claims, 14 Drawing Sheets

T0
P1

Ut

Ue

S3

T1
T2
T3
t

PITCH DATA OUTPUT APPARATUS FOR ELECTRONIC MUSICAL INSTRUMENT HAVING MOVABLE MEMBERS FOR VARYING INSTRUMENT PITCH

BACKGROUND OF THE INVENTION

1. Field of the Invention

The present invention relates to a pitch data output apparatus for outputting pitch data on the basis of a relative movement operation of a pair of movable members and an electronic musical instrument using the same and, more particularly, to a pitch data output apparatus for outputting pitch data corresponding to a pipe position on the basis of a slide operation of a pipe like in a trombone and an electronic musical instrument for generating a musical tone or sound of a pitch corresponding to the pitch data output from the pitch data output apparatus.

2. Description of the Related Art

Wind type instruments include piston type wind instruments such as saxophones, clarinets, and the like each of which designates a pitch by changing a pipe length in such a manner that a plurality of pipe side holes formed on an instrument body are opened/closed with fingers, and slide type wind instruments such as trombones each of which designates a pitch by sliding a movable pipe to change a pipe length.

An electronic wind instrument which constitutes a conventional acoustic wind instrument by electronic circuits is known.

For example, a piston type electronic wind instrument is disclosed in U.S. Pat. No. 3,767,833. The electronic wind instrument has pitch designation switches for designating pitches. When an operator blows a breath into a mouthpiece while he or she operates the pitch designation switches to designate a pitch, a musical tone of the pitch designated upon operation of the pitch designation switches is produced. When the operator makes a lip operation, i.e., bites the mouthpiece during generation of the predetermined musical tone, the designated pitch is changed.

On the other hand, a slide type electronic wind instrument such as a trombone is disclosed in, e.g., U.S. Pat. No. 3,456,062. The electronic wind instrument disclosed in this reference comprises a body, and a movable U-shaped pipe which is slidable along the outer surface of a cylindrical pipe provided to the body. When the U-shaped pipe is slid to increase/decrease the entire pipe length, a pitch can be continuously changed.

In this manner, the slide type electronic wind instrument can continuously change a pitch. For this reason, the slide type electronic wind instrument has a feature of allowing a glissando performance of making a scale stepwise in units of half notes and a portamento performance of continuously changing a pitch, which cannot be realized by the piston type electronic wind instrument which can only designate discontinuous pitches.

The electronic wind instrument disclosed in U.S. Pat. No. 3,456,062 continuously changes a pitch of a musical tone to be generated in accordance with a change in inductance of a magnetic circuit formed between an induction coil provided to the body and a core rod provided to the U-shaped pipe. For this reason, this instrument tends to be influenced by an external inductive hum or the like. Thus, a slide position cannot be accurately detected, and a structure is relatively complicated. In this instrument, since the entire electronic circuit comprises an analog circuit, an operator cannot enjoy a variety of pitch changes. Furthermore, this instrument cannot change a pitch based on a pipe length of the wind instrument in accordance with different characteristics.

SUMMARY OF THE INVENTION

The present invention has been made in consideration of the conventional problems.

Therefore, it is an object of the present invention to provide a pitch data output apparatus which can precisely output pitch data corresponding to a relative distance between first and second movable members with a relatively simple structure when the first and second movable members are moved relative to each other, and, hence, can precisely output the pitch data.

It is another object of the present invention to provide an electronic musical instrument which allows a musical tone performance by changing a pitch stepwise or continuously like in a glissando or portamento performance on the basis of the precisely output pitch data.

It is still another object of the present invention to provide a pitch data output apparatus which allows selection of a conversion characteristic according to which the apparatus converts a distance between first and second movable members into a pitch, according to an operator's will.

It is still another object of the present invention to provide a pitch data output apparatus which allows selection of a conversion characteristic according to which the apparatus converts the positions of first and second movable members into a pitch, according to an operator's will.

It is still another object of the present invention to provide an electronic musical instrument which allows a musical tone performance on the basis of a pitch change characteristic selected according to an operator's will.

FIRST PITCH DATA OUTPUT APPARATUS ACCORDING TO FIRST ASPECT OF PRESENT INVENTION

In order to achieve the above objects, the first pitch data output apparatus comprises first and second movable members which can be relatively moved to approach or separate from each other.

The first movable member has a hollow cylindrical pipe. The second movable member has a substantially U-shaped cylindrical pipe (slide outer pipe) which is slidable along the hollow cylindrical pipe.

A distance measuring means for measuring a distance between the first and second movable members is arranged, e.g., inside a body.

The distance measuring means comprises a transmission means, arranged in at least one of the first and second movable members, for transmitting a sound or electromagnetic wave, a reception means, arranged in at least one of the first and second movable members, for receiving the sound or electromagnetic wave transmitted from the transmission means, a time measuring means for measuring a propagation time until the sound or electromagnetic wave transmitted from the transmission means is received by the reception means, and a distance detection means for detecting a distance between the first and second movable members on the basis of the propagation time measured by the time measuring means.

When the transmission means and the receiving means are arranged at one movable member, e.g., the first movable member, a reflection means for reflecting the sound or electromagnetic wave transmitted by the transmission means is arranged at a predetermined position of the other movable member, e.g., the second movable member.

A pitch data output means for outputting pitch data corresponding to the distance between the first and second movable members measured by the distance measuring means is arranged inside, e.g., the body.

SECOND PITCH DATA OUTPUT APPARATUS ACCORDING TO SECOND ASPECT OF PRESENT INVENTION

The second pitch data output apparatus comprises: first and second movable members which can be relatively moved to approach or separate from each other; distance measurement means for measuring a relative distance between the first and second movable members; selection means for selecting a specific conversion characteristic from the plurality of conversion characteristics; conversion means for converting the relative distance measured by the distance measurement means into corresponding pitch data in accordance with a conversion characteristic selected by the selection means from a plurality of conversion characteristics; and pitch data output means for outputting the pitch data converted by the conversion means.

THIRD PITCH DATA OUTPUT APPARATUS ACCORDING TO THIRD ASPECT OF PRESENT INVENTION

The third pitch data output apparatus comprises first and second movable members which are relatively movable to approach or separate from each other.

A relative position detection means for detecting the position of the second movable member relative to (with respect to) the first movable member is arranged inside, e.g., a body.

In addition, a pitch data output means for outputting pitch data corresponding to the position of the second movable member relative to the first movable member detected by the relative position detection means are arranged inside, e.g., the body.

The second movable member comprises a hollow cylindrical pipe of a flexible conductive material, and a plurality of conductive members are arranged at predetermined intervals in the hollow pipe. The first movable member comprises a hollow cylindrical pipe for covering the second movable member, and has a projection member for pressing the second movable member to bring it into contact with the conductive member.

The relative position detection means detects the position of the second movable member relative to the first movable member on the basis of the conductive member which is in contact with a portion of the second movable member pressed by the projection member of the first movable member.

The relative position detection means has a power source connected to the second movable member, and detects the relative position on the basis of a voltage supplied from the DC power source through the conductive member contacting the second movable member. The second movable member comprises a flexible conductive member or a flexible resistive member.

The first movable member is formed of, e.g., a belt-like resistive member, and the second movable member is formed of a conductive slide member which slides along the resistive member.

The relative position detection means detects the position of the second movable member relative to the first movable member on the basis of an electrical contact position between the slide member and the resistive member. In this case, one end of the resistive member is grounded, and the other end is connected to the power source. The detection means detects the position of the second movable member relative to the first movable member on the basis of a voltage value appearing at the contact position between the slide member and the resistive member.

The relative position detection means comprises a rotary variable resistor which pivots upon movement of the first movable member, and a position detection means for detecting the position of the second movable member relative to the first movable member on the basis of a resistance obtained from the variable resistor.

The rotary variable resistor is connected to the DC power source through a resistor (fixed resistor) one end of which is grounded, and the other end of which has a fixed resistance. When the first movable member is moved, the resistance of the rotary variable resistor is changed, and a voltage value across the fixed resistor is changed according to the changed resistance.

The relative position detection means detects the position of the second movable member relative to the first movable member on the basis of a change in voltage value across the fixed resistor.

ELECTRONIC MUSICAL INSTRUMENT ACCORDING TO FIRST ASPECT OF PRESENT INVENTION

The first electronic musical instrument comprises the pitch data output apparatus according to the first or second aspect of the present invention, an air flow state detection means for detecting an air flow state, and a musical tone generation instruction means for instructing to generate a musical tone having a pitch corresponding to the pitch data output from the pitch data output apparatus on the basis of the air flow state detected by the air flow state detection means.

The air flow state detection means comprises a mouthpiece, and a detection means for detecting a flow state of air flowing into the mouthpiece or a flow state of air flowing out from the mouthpiece. In addition, the air flow state detection means may comprise a sensor for detecting a flow state of a wind (air) flowing into from a member for blowing a wind like a bellows, or a sensor for detecting a flow state of air flowing into from a member such as an accordion for blowing air by expanding/contracting a bellows.

ELECTRONIC MUSICAL INSTRUMENT ACCORDING TO SECOND ASPECT OF PRESENT INVENTION

The second electronic musical instrument comprises the pitch data output apparatus according to the first or second aspect of the present invention, a bite pressure sensor means for detecting a bite pressure, and a musical tone generation instruction means for instructing to generate a musical tone having a pitch corresponding to the pitch data on the basis of the bite pressure detected by the bite pressure sensor means.

The operations of the present invention will be described below.

OPERATION OF PITCH DATA OUTPUT APPARATUS ACCORDING TO FIRST AND SECOND ASPECTS

When the first or second movable member is relatively moved, a distance between the first and second movable members is changed. The changed relative distance between the two members is sequentially measured by the distance measuring means. The measured relative distance is output to the pitch data output means. The pitch data output means outputs pitch data corresponding to the relative moving distance measured by the distance measuring means to the pitch detection means.

The distance measuring means comprises the transmission means, the reception means, the time measuring means, and the distance detection means. In this case, these means detect the relative distance between the first and second movable members by the following operation.

The transmission means intermittently transmits the sound or electromagnetic wave at predetermined time intervals. The transmission means is arranged in at least one of the first and second movable members. On the other hand, the reception means is arranged in one of the first and second movable members. The sound or electromagnetic wave transmitted from the transmission means propagates from one movable member to the other movable member, and is received by the reception means. The time measuring means starts measurement of a time simultaneously with transmission of the sound or electromagnetic wave by the transmission means, and measures a propagation time until the sound or electromagnetic wave transmitted from the transmission means is received by the reception means. The time measuring means then outputs the measured propagation time to the distance detection means.

The distance detection means detects a distance between the first and second movable members on the basis of the propagation time of the sound or electromagnetic wave measured by the time measuring means.

Therefore, when this apparatus is applied to a slide type acoustic wind instrument such as a trombone, a pitch corresponding to a slide operation of, e.g., a slide outer pipe can be precisely detected.

OPERATION OF PITCH DATA OUTPUT APPARATUS ACCORDING TO THIRD ASPECT OF PRESENT INVENTION

Upon operation of the first or second movable member, the position of the second movable member relative to the first movable member is changed. The relative position is sequentially detected by the relative position detection means. The detected relative position is output to the pitch data output means. The pitch data output means converts the relative position detected by the relative position detection means into corresponding pitch data.

Upon slide movement of the first or second movable member, the position of the second movable member relative to the first movable member is continuously changed. A movable range of the second movable member relative to the first movable member by the slide movement is segmented, and pitches are assigned to the segmented ranges. Thus, the pitch data output means outputs pitch data assigned in advance to a position detected by the relative position detection means. For this reason, a glissando performance of changing a pitch in units of half notes, a portamento performance of continuously changing a pitch, a vibrato performance of changing a pitch at small time intervals, or the like can be realized by the slide movement of the first or second movable member.

OPERATION OF ELECTRONIC MUSICAL INSTRUMENT ACCORDING TO FIRST ASPECT

An air flow state is detected by the air flow state detection means.

The musical tone generation instruction means instructs to generate a musical tone having a pitch corresponding to the pitch data output from the first or second pitch data output apparatus on the basis of the air flow state detected by the air flow state detection means. A sound source produces a musical tone having the pitch corresponding to the pitch data, in accordance with this instruction.

Therefore, an operator performs a breath operation for blowing or taking a breath into or from the mouthpiece, an operation for a bellows, or an extending/retracting operation for an extendable member so as to control generation/stopping of a musical tone having a pitch designated by the slide operation of the first or second movable member.

Therefore, the first electronic musical instrument allows a musical tone performance with a glissando, portamento, tamento, or vibrato effect on the basis of the same operation as in a slide type acoustic wind instrument such as a trombone.

OPERATION OF ELECTRONIC MUSICAL INSTRUMENT ACCORDING TO SECOND ASPECT

A bite pressure at which an operator bites the mouthpiece (a strength of bite pressure) is detected by the bite pressure sensor means.

The musical tone generation instruction means instructs to control start or stop of generation (key ON or key OFF) of the first or second pitch data output apparatus. A built-in or external sound source outputs a musical tone in accordance with this instruction.

Therefore, in the electronic musical instrument according to the second aspect of the present invention, an operator can enjoy a performance with a glissando, portamento, or vibrato effect based on the movement operation of the first or second movable member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Preferred embodiments of the present invention will be described hereinafter with reference to the accompanying drawings.

FIRST EMBODIMENT

Figure 1A:
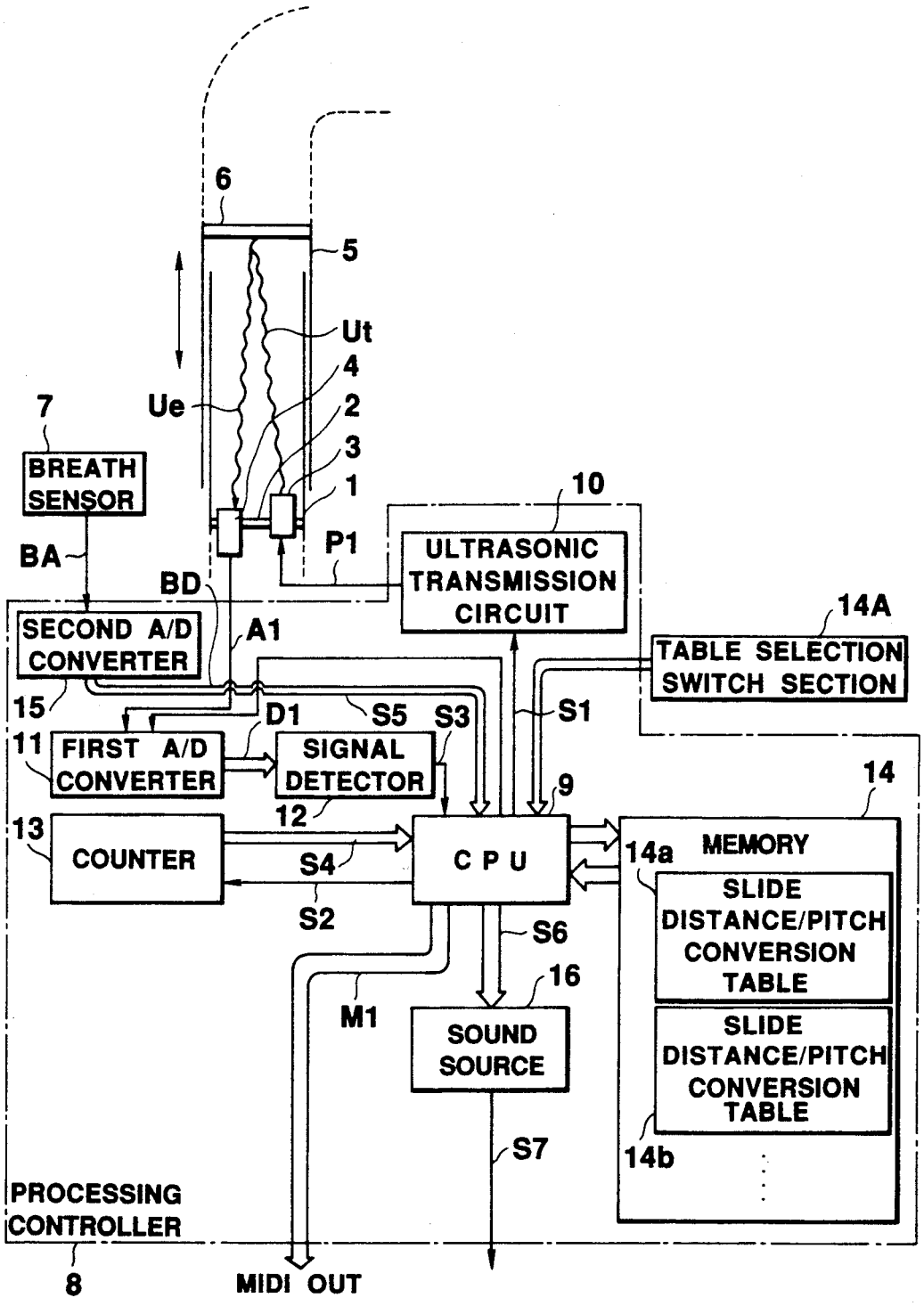
FIG. 1A is a block diagram showing a system configuration according to the first embodiment of the present invention.
Figure 1B:
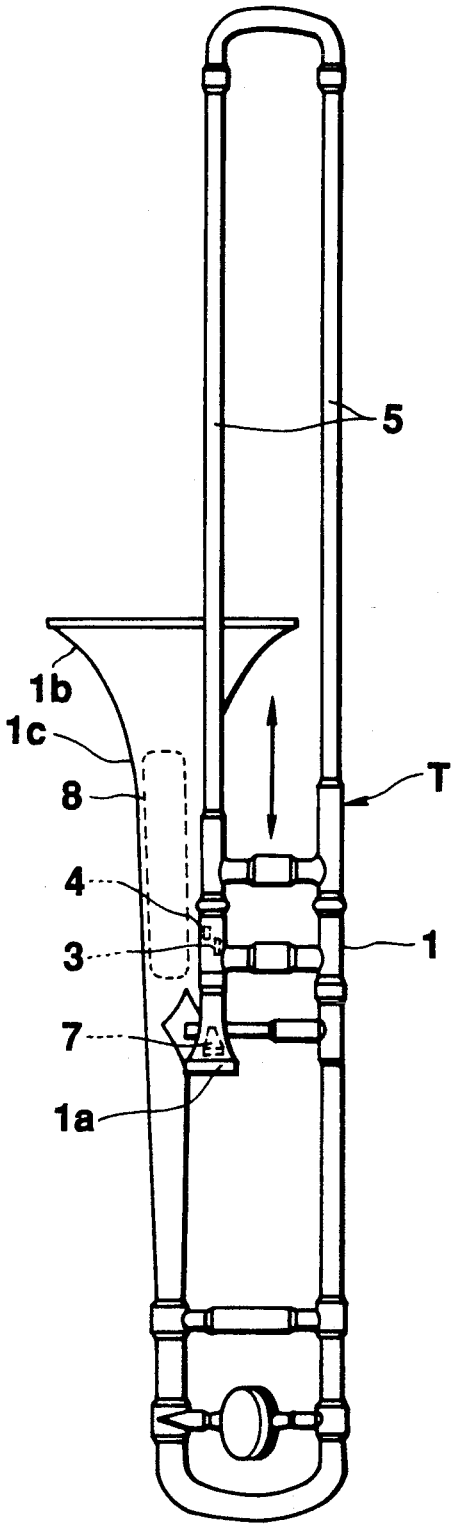
FIG. 1B is a side view showing the overall outer appearance of an electronic trombone of the first embodiment.

FIG. 1A shows a system configuration according to the first embodiment of the present invention, and FIG. 1B shows the outer appearance of an electronic trombone to which the present invention is applied.

As shown in FIG. 1B, a pipe 1 as a portion of a trombone body T is a metal pipe having a cylindrical section. A lid 2 on which an ultrasonic transmitter 3, comprising a piezoelectric element of a ceramic of, e.g., lead-zirconate titanate (PZT), for transmitting an ultrasonic wave Ut, and an ultrasonic sensor 4 for detecting a reflection wave Ue (echo) of the ultrasonic wave Ut generated by the ultrasonic transmitter 3 are fixed, is fitted in a portion of the pipe 1, as shown in FIG. 1A. The pipe 1 is closed by the lid 2.

A slide outer pipe 5 is a U-shaped pipe having a circular section, which corresponds to a hand slide of a trombone. The inner diameter of the slide outer pipe 5 is slightly larger than the outer diameter of the pipe 1. For this reason, the slide outer pipe 5 can be slid along the outer surface of the pipe 1 of the body. As shown in FIG. 1A, a reflection plate 6 of a metal having a high reflectivity of an ultrasonic wave is fitted in the slide outer pipe 5 to extend in a direction perpendicular to the longitudinal direction of the pipe 1. When an ultrasonic wave transmitted from the ultrasonic transmitter 3 propagates through a hollow portion defined in the pipe 1 of the body and the slide outer pipe 5 and reaches the reflection plate 6, it is reflected by the reflection plate 6. The echo Ue is detected by the ultrasonic sensor 4 when it reaches the sensor 4.

As shown in FIG. 1B, one end of the body pipe 1 constitutes a horn-like mouthpiece 1*a*. A breath sensor 7 for detecting a flow state, e.g., an air amount or air flow rate, of air blown into the mouthpiece 1*a* is arranged inside the mouthpiece 1*a*.

A processing controller 8 is disposed in a bell pipe 1*c* adjacent to a bell 1*b*, as shown in FIG. 1B. The processing controller 8 comprises a CPU (central processing unit) 9 of, e.g., a microprocessor; an ultrasonic transmission circuit 10 for applying a predetermined high-frequency pulse $P_1$ to the ultrasonic transmitter 3 in accordance with an ultrasonic transmission signal S1 supplied from the CPU 9 to cause it to generate the ultrasonic wave Ut at a frequency of, e.g., 400 kHz to 1 MHz according to the frequency of the high-frequency pulse $P_1$; the ultrasonic sensor 4 for receiving the echo Ue, reflected by the reflection plate 6, of the ultrasonic wave Ut transmitted from the ultrasonic transmitter 3; a first A/D converter 11 for converting an analog sense signal A1 similar to the echo Ue output from the ultrasonic sensor 4 into digital data D1; a signal detector 12 for, when the value of the digital data D1 output from the first A/D converter 11 is equal to or larger than a predetermined threshold value, outputting "H" level; a counter 13 for starting counting in response to a count control signal S2 for instructing to start counting from the CPU 9, ending counting in response to the control signal S2 for instructing to end counting from the CPU 9, and outputting distance data S4 indicating a distance from the lid 2 to the reflection plate 6 fixed to the slide outer pipe 5 (to be referred to as a "pipe length" hereinafter for the sake of simplicity); a memory 14, comprising, e.g., a ROM (read-only memory) or a RAM (random-access memory), for storing a control program of the CPU 9, a plurality of distance/pitch conversion tables 14*a*, 14*b*, . . . , for converting the distance data S4 output from the counter 13 into pitch data, and the like; a second A/D converter 15 for converting analog breath data BA output from the breath sensor 7 into corresponding digital breath data BD; and a digital sound source 16 of a PCM sound source type, an FM sound source type, or an iPD sound source type for producing a musical tone having a pitch corresponding to the pitch data supplied from the CPU 9 according to a musical tone characteristic based on musical tone control data supplied from the CPU 9.

Figure 2A:
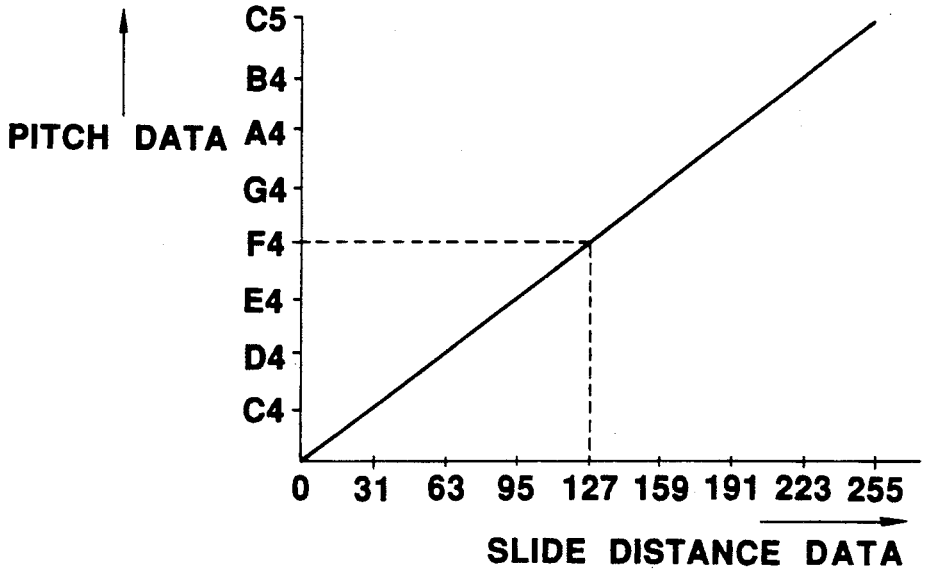
FIGS. 2A are graphs showing contents of a distance/pitch conversion table.
Figure 2B:
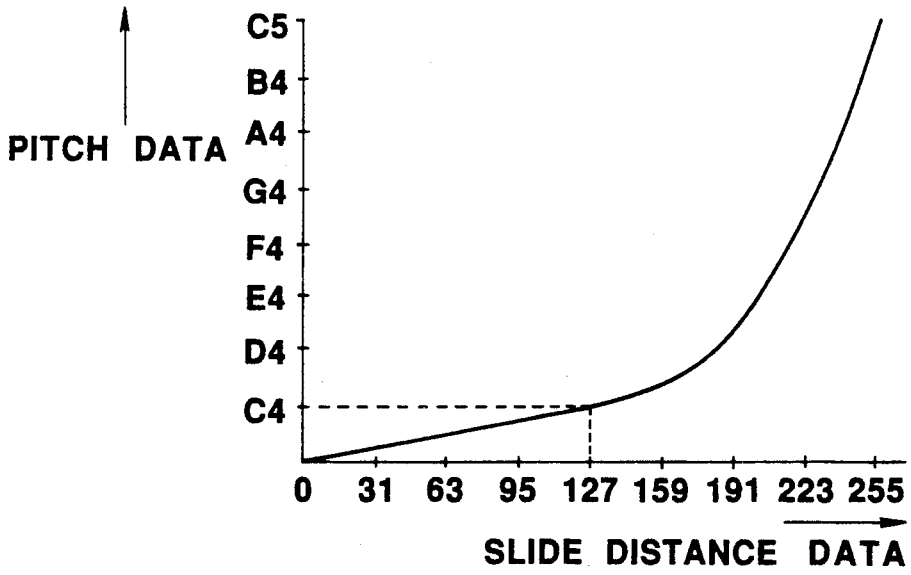

The distance/pitch conversion table 14*a* stores a large number of pairs of pitch data and distance data representing characteristics with which a value of pitch data (in this embodiment, from a pitch $C_4$ to a pitch $C_5$ one octave higher than $C_4$) proportionally increases along with an increase in value of distance data (in this embodiment, 8-bit digital data), as shown in FIG. 2A. The distance/pitch conversion table 14*b* stores a large number of pairs of pitch data and distance data representing characteristics with which a value of pitch data exponentially increases along with an increase in value of the distance data, as shown in FIG. 2B. A plurality of conversion tables similar to the distance/pitch conversion tables 14*a* and 14*b* are stored in the memory 14. A desired one of these tables 14*a*, 14*b*, . . . is selected upon operation of a table selection switch section 14A. The tables can be replaced by circuits for converting the distance data to pitch data by arithmetic operations.

OPERATION

The operation of the arrangement shown in FIGS. 1A and 1B will be described below with reference to the timing charts of FIGS. 3A to 3D.

When an operator wants to generate a musical tone, he turns on an ON/OFF (power) switch to enable the processing controller 8, and the like. The operator slides the slide outer pipe 5 to a position corresponding to a desired pitch, and then performs a breath operation of blowing a breath into the mouthpiece 1*a*. With these operations of the operator, the processing controller 8 executes the following processing.

When the instrument is powered upon operation of the power switch, the CPU 9 supplies the ultrasonic transmission signal S1 and the count control signal S2 to the ultrasonic transmission circuit 10 and the counter 13 to cause them to start their operations, respectively.

Figures 3A, 3B, 3C, 3D:
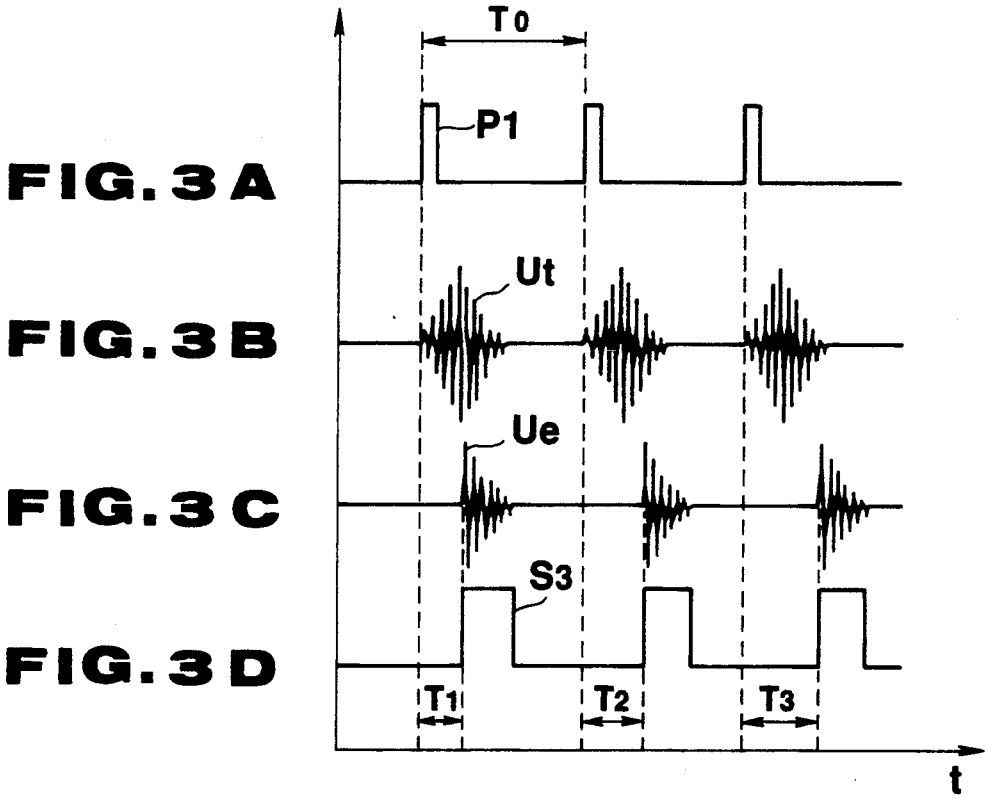
FIGS. 3A to 3D are timing charts for explaining the operation of the first embodiment.

Upon reception of the ultrasonic transmission signal S1 from the CPU 9, the ultrasonic transmission circuit 10 applies the high-frequency pulse $P_1$ having a predetermined period $T_0$ shown in the timing chart of FIG. 3A to the ultrasonic transmitter 3.

The ultrasonic transmitter 3 generates the ultrasonic wave Ut having a predetermined frequency (e.g., 400 kHz to 1 MHz) shown in FIG. 3B in response to the pulse $P_1$. The ultrasonic wave Ut propagates through a hollow portion defined in the pipe 1 of the body and the slide outer pipe 5 (to be expressed as "inside the pipes" hereinafter for the sake of simplicity).

In response to the count control signal S2 for instructing to start counting from the CPU 9, the counter 13 starts counting in synchronism with transmission of the ultrasonic wave Ut by the ultrasonic transmitter 3.

The ultrasonic wave Ut propagates inside the pipes, reaches the reflection plate 6 fitted in the slide outer pipe 5, and is then reflected by the reflection plate 6. The echo Ue of the ultrasonic wave Ut propagates inside the slide pipes 5, and reaches the ultrasonic sensor 4 fixed to the lid 2.

When the ultrasonic sensor 4 detects the echo Ue of the ultrasonic wave Ut shown in FIG. 3C, it outputs the analog sense signal A1 corresponding to the waveform of the detected echo Ue to the first A/D converter 11.

The first A/D converter 11 converts a signal level of an envelope of the analog sense signal A1 into the digital data D1, and supplies the digital data to the signal detector 12.

An output S3 of the signal detector 12 goes to "H" level, as shown in FIG. 3D, while the value indicated by the digital data D1 supplied from the first A/D converter 11 exceeds a predetermined threshold value, i.e., the ultrasonic sensor 4 receives the echo Ue.

The CPU 9 supplies the count control signal S2 for instructing to stop counting to the counter 13 when the output from the signal detector 12 goes from "L" level to "H" level, i.e., when the ultrasonic sensor 4 surely detects the echo Ue. In response to the count control signal S2 for instructing to stop counting, the counter stops counting.

The counter 13 starts counting when the ultrasonic wave Ut is transmitted, and counts the number of clock signals until the echo Ue of the ultrasonic wave Ut is received by the ultrasonic sensor 4. The count value of the counter 13 is a value proportional to a distance up to the reflection plate 6, i.e., a pipe length as distance data S4. Therefore, as shown in FIG. 3D, a counting time of the counter 13 sequentially changes like $T_1$, $T_2$, and $T_3$ in correspondence with a change in pipe length upon slide operation of the slide outer pipe 5.

The CPU 9 looks up one of the distance/pitch conversion tables 14*a*, 14*b*, . . . , selected by the table selection switch section 14A stored in the memory 14 on the basis of the slide distance data S4 supplied from the counter 13, thus obtaining pitch data corresponding to the distance data (pipe length data). The CPU 9 generates control data S6 for generating a musical tone having a pitch corresponding to the obtained pitch data or MIDI (Musical Instrument Digital Interface) message M1 complying with the MIDI standards, and outputs it to the sound source 16 or an MIDI OUT terminal.

With the above-mentioned operations, when the operator slides the slide outer pipe 5, a pitch corresponding to the pipe length determined by the slide operation is detected (determined).

More specifically, when the operator slides the slide outer pipe 5, the reflection plate 6 is also moved, and the propagation distance of the ultrasonic wave Ut transmitted from the ultrasonic transmitter 3 and the echo Ue is also changed. The propagation time corresponds to a time from when the ultrasonic wave Ut is transmitted from the ultrasonic transmitter 3 until the echo Ue reaches the ultrasonic sensor 4. The time from when the ultrasonic wave Ut is transmitted from the ultrasonic transmitter 3 until it is received by the ultrasonic sensor 4 (to be referred to as a propagation time T of the ultrasonic wave Ut hereinafter for the sake of simplicity) is counted by the counter 13.

More specifically, the count value data of the counter 13 is proportional to the propagation time T of the ultrasonic wave Ut as the distance data S4. Therefore, the CPU 9 can precisely detect the pipe length determined by the slide operation of the slide outer pipe 5 by the operator in real time on the basis of the distance data S4 from the counter 13.

After the slide operation of the slide outer pipe 5 is performed to designate a desired pitch, the operator performs a breath operation for blowing a breath into the mouthpiece 1*a* of the body in this state, so that the strength of the breath operation is detected by the breath sensor 7. The breath sensor 7 outputs the analog breath data BA corresponding to the detected breath strength to the second A/D converter 15. The second A/D converter 15 converts the analog breath data BA into corresponding digital breath data BD, and outputs the digital data to the CPU 9.

When the value indicated by the input breath data BD exceeds a predetermined threshold value, the CPU 9 outputs a note-ON signal for instructing to start generation of a musical tone to the sound source 16. After the CPU 9 outputs the note-ON signal to the sound source 16, it sequentially reads out the breath data BD from the second A/D converter 15, and forms tone volume control data for designating a tone volume level of a musical tone on the basis of the readout breath data BD. The CPU 9 outputs the formed tone volume control data to the sound source 16.

With the above operation, when the breath operation of blowing a breath into the mouthpiece 1*a* is performed at a predetermined strength or more, the sound source 16 generates a musical tone having a pitch corresponding to the position of the slide outer pipe 5 at a predetermined tone volume. The tone volume of the generated musical tone is varied in correspondence with the strength of the breath operation.

When the value of the breath data BD read out from the second A/D converter 15 is changed to be equal to or smaller than the predetermined threshold value while the sound source 16 is generating a musical tone, the CPU 9 outputs a note-OFF signal for instructing to stop generation of a musical tone to the sound source 16.

Therefore, when the breath operation at the mouthpiece 1*a* is stopped, the generation of a musical tone from the sound source 16 is stopped.

The period $T_0$ of the ultrasonic wave Ut transmitted from the ultrasonic transmitter 3 must be set to be longer than the propagation time (maximum propagation time) of the ultrasonic wave Ut when a distance between the lid 2 and the reflection plate 6 is the maximum for the following reason. That is, if the period $T_0$ is shorter than the maximum propagation time of the ultrasonic wave Ut, the counter 13 must start measurement of the propagation time of the next ultrasonic wave Ut before it ends measurement of the propagation time of the echo Ue of the immediately preceding ultrasonic wave Ut.

In the first embodiment, the reflection plate 6 is fitted in the slide outer pipe 5, so that the ultrasonic wave Ut transmitted from the ultrasonic transmitter 3 is reflected by the reflection plate 6, and the echo Ue is received by the ultrasonic sensor 4 arranged in the pipe 1. However, the present invention is not limited to this. For example, the ultrasonic transmitter may be disposed in one of the pipe 1 and the pipe 5, and the ultrasonic sensor may be disposed in the other of the pipe 1 and the pipe 5, so that an ultrasonic wave transmitted from the ultrasonic transmitter is directly received by the ultrasonic sensor. Thus, the propagation time of the ultrasonic wave can be measured, i.e., the position of the slide outer pipe can be detected without arranging the reflection plate.

When the distance/pitch conversion tables 14*a*, 14*b*, . . . stored in the memory 14 are appropriately formed, a pitch corresponding to the position of the slide outer pipe which changes according to the slide operation of the slide outer pipe can be almost continuously changed. For example, if the content of each distance/-pitch conversion table is set to be able to change a pitch in units of 1/100 of a half note (i.e., 1cent) or less, a pitch can be more precisely detected (determined) in units of cents or in units of intervals smaller than 1 cent. For this reason, in this embodiment, not only glissando but also portamento performance can be enjoyed.

In this embodiment, the pipe length is measured by utilizing an ultrasonic wave. However, the pipe length may be measured by utilizing an electromagnetic wave of an infrared sensor, a surface acoustic device, a photosensor using a photodiode and a photocell, a laser, or the like.

SECOND EMBODIMENT

Figure 4:
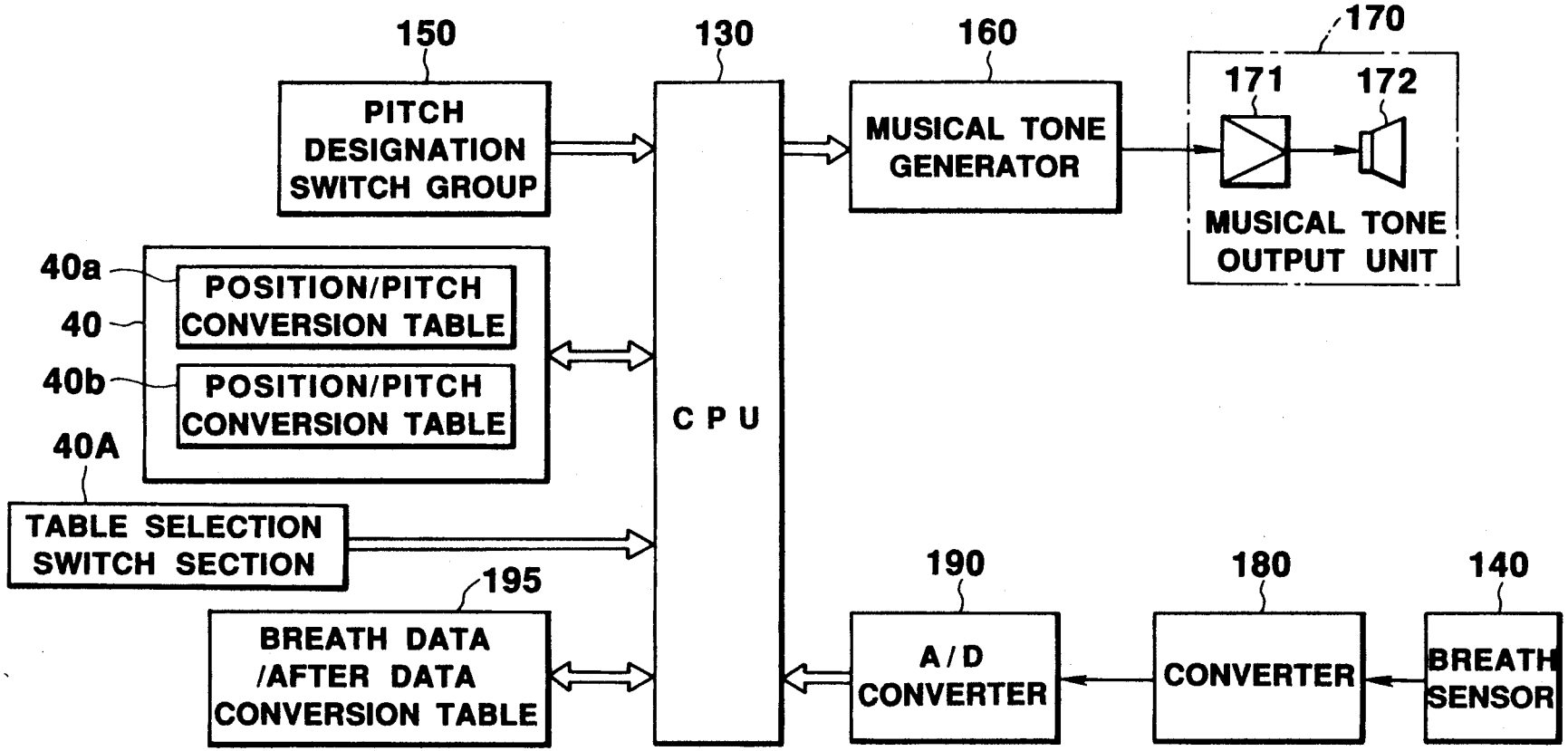
FIG. 4 is a block diagram showing a system configuration according to the second embodiment of the present invention.
Figure 5:
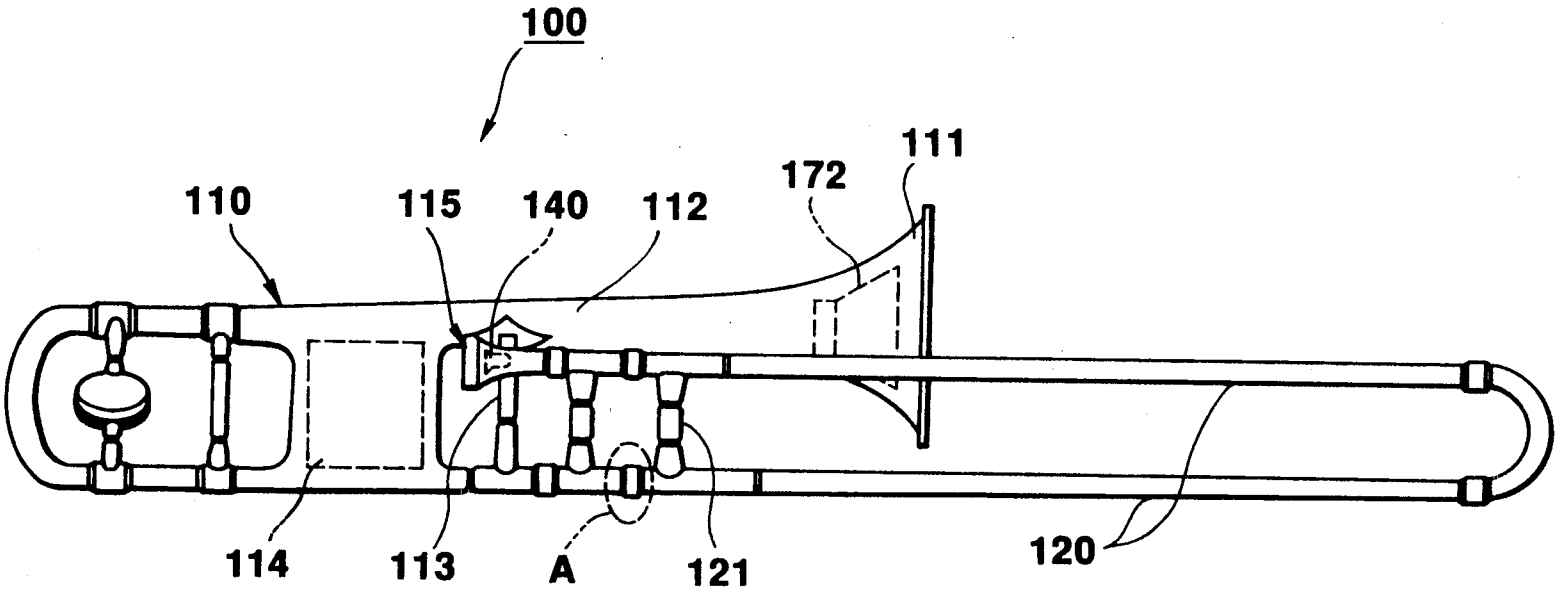
FIG. 5 is a side view showing the outer appearance of an electronic wind instrument according to the second embodiment of the present invention.

FIG. 4 shows an arrangement of a system according to the second embodiment of the present invention, and FIG. 5 shows the outer appearance of an electronic wind instrument 100 to which the second embodiment is applied.

As shown in FIG. 5, the electronic wind instrument 100 comprises: a body 110; and a U-shaped slide outer pipe 120 which is slidable along the outer surface of an inner pipe (not shown in FIG. 5) and constitutes a second movable member.

The body 110 is constituted by a bell 11, a bell pipe 112, a brace 113 gripped by the left hand to support the body 110, an electronic circuit housing 114 housing an electronic circuit for performing musical tone generation control (to be described in detail later), a mouthpiece 115 incorporating a breath sensor 140 for detecting a blown breath strength, and the like.

A brace 121 gripped by the right hand to slide the slide outer pipe 120 is formed on the slide outer pipe 120. When the brace 121 is slid, the slide outer pipe 120 is slid, thus increasing/decreasing the pipe length of the musical instrument.

Figure 6A:
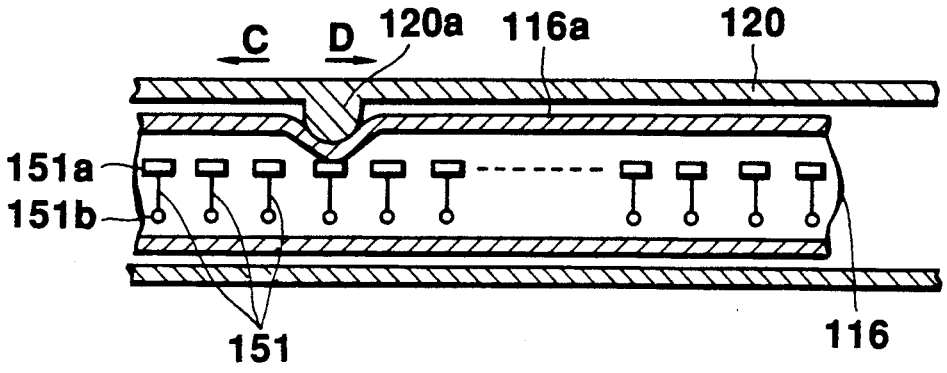
FIG. 6A is a sectional view of outer and inner pipes.

FIG. 6A is an enlarged sectional view of a portion indicated by a broken line A in FIG. 5, i.e., an engaging portion between an inner pipe 116 as a portion of the body 110 and the slide outer pipe 120.

The inner pipe 116 inserted in the slide outer pipe 120 is formed of a flexible conductive member 116*a* having high flexibility and conductivity, and constitutes a first movable member. One end of the flexible conductive member 116*a* is connected to a DC power source (not shown).

A plurality of pitch designation switches 151 each comprising a conductive element 151*a* and a terminal 151*b* connected to an input port of a CPU 130 (to be described later) are arranged at equal intervals inside (in a hollow portion of) the inner pipe 116. The conductive elements 151*a* of the pitch designation switches 151 are normally separated from the flexible conductive member 116*a*. Note that the plurality of pitch designation switches 151 will be referred to as a pitch designation switch group 150 hereinafter.

A hard projection 120*a* locally projects from the slide outer pipe 120 radially inward. The projection 120*a* pushes a portion of the flexible conductive member 116*a* which is brought into contact with it radially inward to bring the portion of the conductive member 116*a* into contact with the conductive element 151*a* of the corresponding pitch designation switch 151 arranged below the projection 120*a*.

When an operator grips the brace 121 with his right hand and slides the slide outer pipe 120 in a C or D direction in FIG. 6A, the projection 120*a* of the slide outer pipe 120 is moved in the C or D direction. Upon movement of the projection 120*a*, the flexible conductive member 116*a* is sequentially brought into contact with the pitch designation switch group 150 in the alignment order in the C or D direction.

Figure 6B:
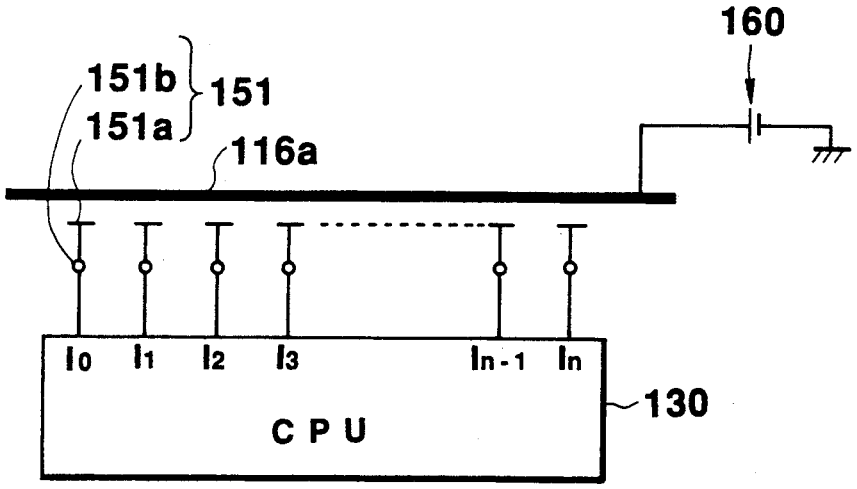
FIG. 6B is a circuit diagram of a portion for performing pitch designation control of a second electromagnetic wave.

FIG. 6B shows an equivalent circuit comprising the flexible conductive member 116*a*, the pitch designation switch group 150, and the DC power source 160. When the slide outer pipe 120 is slid, a portion of the flexible conductive member 116*a* which is pushed by the projection 120*a* of the slide outer pipe 120 is brought into contact with the corresponding pitch designation switch 151. An output voltage from the DC power source 160 is applied to a port of the CPU 130 corresponding to the pitch designation switch 151 contacting the flexible conductive member 116*a* (to be referred to as the "ON" switch 151 hereinafter) through the ON pitch designation switch 151.

The CPU 130 detects the port applied with the output voltage of the DC power source 160. The CPU 130 generates pitch data corresponding to the detected ON pitch designation switch 151.

Therefore, for example, if pitches in a compass starting from "E" of a great octave to "$C_2$" of a two-lined octave are assigned in turn at half-note intervals or less to the pitch designation switches 151, a glissando or portamento performance is allowed upon sliding of the slide outer pipe 120.

FIG. 4 is a block diagram showing a system configuration of the electronic wind instrument 100 having the outer appearance and internal arrangement as described above.

The pitch designation switch group 150 consists of the plurality of pitch designation switches 151 which are arranged inside the inner pipe 116 and to which pitches in a compass starting from "E" of the great octave to "$C_2$" of the two-lined octave are assigned at half-note intervals or less, as shown in FIGS. 6A and 6B.

As shown in FIG. 6B, the terminals 151*b* of the pitch designation switches 151 are connected to input ports Ii (i=1, 2, . . . , n) of the CPU 130 to have a one-to-one correspondence with them. The CPU 130 scans the input ports Ii at predetermined time intervals (a time interval shorter than a minimum time interval for continuously turning on the adjacent pitch designation switches 151 when the operator slides the slide outer pipe 120). The CPU 130 generates pitch data corresponding to the ON pitch designation switch 151, and outputs it to a musical tone generator 160.

The musical tone generator 160 generates a digital musical tone having a pitch corresponding to the pitch data supplied from the CPU 130 by, e.g., a PCM sound source system, an FM sound source system, an iPD sound source system, or the like. The musical tone generator 160 converts the digital musical tone waveform into an analog musical tone by a built-in D/A converter (digital-to-analog converter), and outputs the analog musical tone to a musical tone output unit 170 consisting of an amplifier 171, a loudspeaker 172, and the like. The musical tone output unit 170 amplifies the input analog musical tone by the amplifier 171, and externally produces the amplified musical tone through the loudspeaker 172.

The breath sensor 140 arranged in the mouthpiece 115, as shown in FIG. 5, detects a flow state of air blown into the mouthpiece 115, e.g., an air amount, an air flow rate, or an air pressure (corresponding to a blown breath strength). The breath sensor 140 outputs breath data corresponding to the detected air flow state to a converter 180. The converter 180 converts the breath data into a corresponding analog voltage, and applies the voltage to an A/D converter 190. The A/D converter 190 converts the input analog voltage into digital breath data consisting of a predetermined number of bits (8 bits in this embodiment), and outputs the digital breath data to the CPU 130.

The CPU 130 reads the breath data output from the A/D converter 190 at predetermined time intervals. The CPU 130 determines, based on the read breath data, output timings of key ON data instructing to start generation of a musical tone and key OFF data for instructing to stop a musical tone in generation, which are output to the musical tone generator 160.

A breath data/after data conversion table 195 is used for converting the breath data read out from the A/D converter 190 into after data for instructing a tone volume of a musical tone in generation. This table is stored in, e.g., a ROM (read-only memory).

The CPU 130 reads out the breath data from the A/D converter 190 during generation of a musical tone, and then reads out after data corresponding to the breath data from the breath data/after data conversion table 195. The CPU 130 outputs the after data as data for instructing a tone volume of a musical tone in generation to the musical tone generator 160.

The operation of the electronic wind instrument according to the second embodiment with the above arrangement will be described below with reference to FIGS. 7A and 7B, and flow charts of FIGS. 8 and 9.

Figures 7A, 7B:
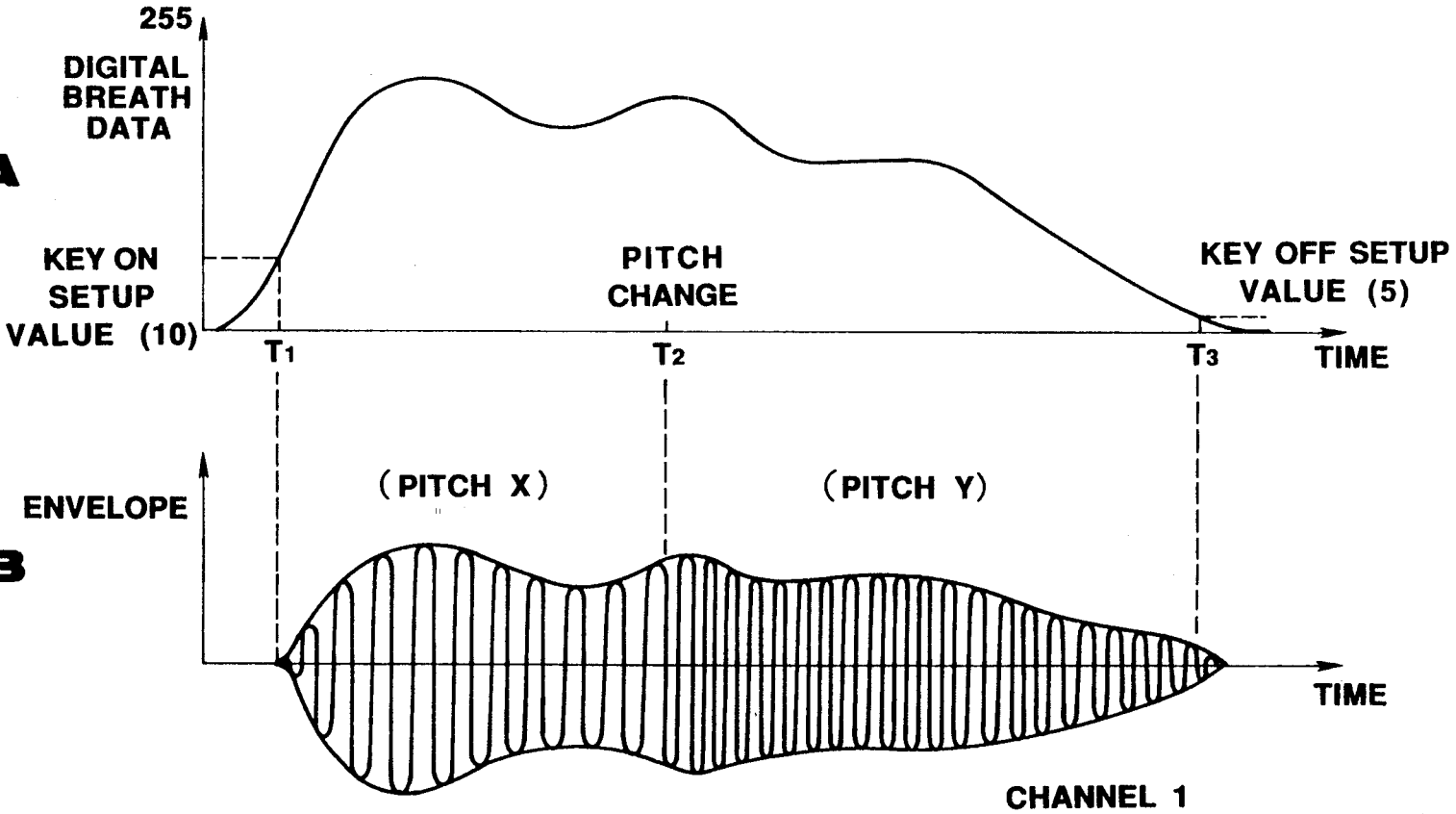
FIGS. 7A and 7B are graphs for explaining musical tone control based on breath data.

FIGS. 7A and 7B are views for explaining a musical tone control method when the slide outer tube 120 is slid during generation of a musical tone having a predetermined pitch to turn on the pitch designation switch 151 adjacent to the current ON switch 151, according to the characteristic feature of the present invention.

In FIG. 7A, the value of digital breath data read from the A/D converter 190 by the CPU 130 is plotted along the ordinate, and time is plotted along the abscissa. That is, FIG. 7A shows a change in digital breath data read from the A/D converter 190 by the CPU 130 as a function of time. In FIG. 7B, the magnitude of an envelope output from the musical tone generator 160 is plotted along the ordinate. That is, FIG. 7B expresses a change in tone volume of a musical tone to be generated as a function of time.

In FIGS. 7A and 7B, a musical tone having an initially designated pitch X is produced from time $T_1$ in a channel 1 according to a predetermined envelope on the basis of the breath operation by an operator. The operator slides the slide outer pipe 120, and another pitch designation switch 151 is turned on at time $T_2$ to change the designated pitch X to a pitch Y. In this case, a tone volume of a musical tone in generation is controlled in accordance with the breath operation state. The pitch of a musical tone in generation is changed from the pitch X to the new pitch Y at time $T_2$. Therefore, in this embodiment, it is not the case that generation of a musical tone having the new pitch Y is started from time $T_2$ after generation of the musical tone having the pitch X in generation is temporarily stopped. Note that the CPU 130 maintains an envelope (tone volume) corresponding to a level value of the digital breath data until key OFF processing is performed at time $T_3$ when the operator stops the breath operation.

According to this embodiment, even when a pitch is changed during generation of a musical tone based on the breath operation, only the pitch of the musical tone in generation is changed, and the tone volume of the musical tone is changed according to the strength of the breath operation. Therefore, very natural musical tone control can be attained. For this reason, a glissando or portamento performance can be naturally executed like in a performance by an acoustic musical instrument.

Figure 8:
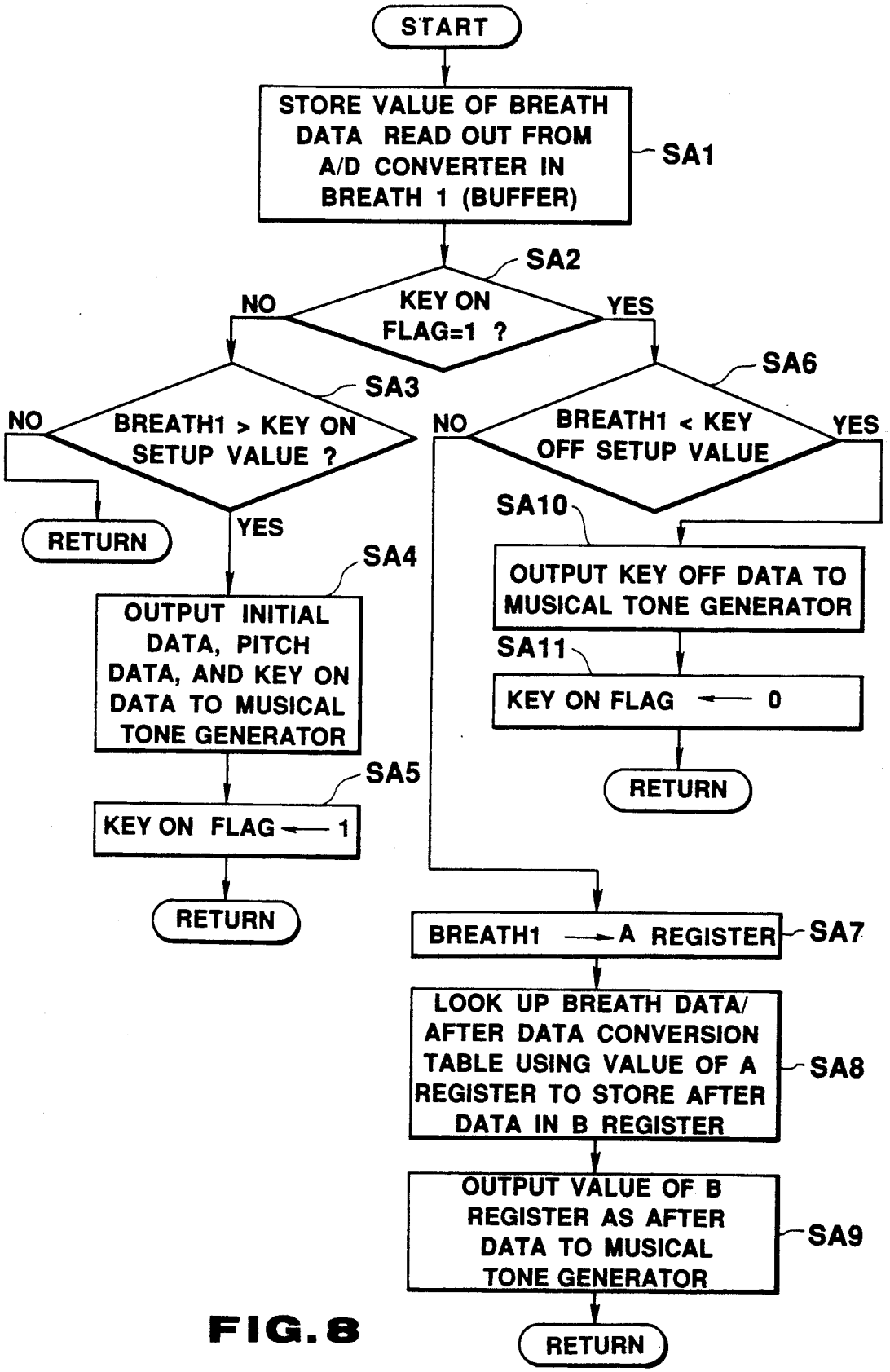
FIG. 8 is a flow chart for explaining musical tone control processing based on breath data executed by a CPU.

FIG. 8 is a flow chart for explaining musical tone control processing based on breath data by the CPU 130 for performing performance control described above.

The CPU 130 executes the processing shown in the flow chart of FIG. 8 by timer interrupts periodically generated at predetermined time intervals (e.g., several msec).

When an operator performs a breath operation at the mouthpiece 115, the strength of the breath operation is detected by the breath sensor 140. The breath sensor 140 supplies breath data corresponding to the detected strength of the breath operation to the converter 180. The output from the converter 180 is input to the A/D converter 190. For this reason, the breath data is converted to the digital breath data.

The CPU 130 reads out the digital breath data output from the A/D converter 190. The CPU 130 stores the readout digital breath data in a buffer BREATHl (not shown) (SA1).

The CPU 130 checks if a key ON flag is "1" (SA2). Although not shown, the key ON flag is allocated in the CPU 130, and indicates whether or not a musical tone is being generated. If a musical tone is being generated, the key ON flag stores "1"; otherwise, it stores "0".

If it is determined in step SA2 that the key ON flag is "0", i.e., no musical tone is being generated, the flow advances to step SA3. It is checked in step SA3 if the value of the breath data stored in the buffer BREATHl exceeds a key ON setup value (e.g., "10" in FIG. 7A) as a threshold value for instructing to generate a musical tone. If the value of the breath data is equal to or smaller than the key ON setup value, it is determined that no breath operation is performed or the breath operation is very weak. The flow immediately returns to the main routine.

If it is determined in step SA3 that the value of the breath data stored in the register BREATHl exceeds the key ON setup value, the flow advances to step SA4. The CPU 130 generates initial data instructing a tone volume at the beginning of musical tone generation on the basis of the value of the breath data stored in the register BREATHl. The CPU 130 outputs the generated initial data, pitch data stored in a register BSWBl (to be described later), and key ON data to the musical tone generator 160 (SA4). The CPU 130 then sets the key ON flag to be "1" (SA5).

With the above-mentioned operation, when the operator performs the breath operation at the mouthpiece 115 at a predetermined strength or more, a musical tone having a pitch corresponding to the position of the slide outer pipe 120 is generated from the musical tone generator 160 at a tone volume corresponding to the breath operation (see time $T_1$ in FIG. 7A) in response to it. In addition, the key ON flag indicating that a musical tone is being generated is set to be "1".

If it is determined in step SA2 that the key ON flag is "1", i.e., a musical tone is being generated, the flow advances to step SA6. It is checked in step SA6 if the value of the breath data stored in the buffer BREATHl is smaller than a key OFF setup value (e.g., "5" in FIG. 7A) as a threshold value for stopping generation of a musical tone. If NO in step SA6, i.e., if it is determined that the value of the breath data is equal to or larger than the key OFF setup value, the value of the latest breath data stored in the buffer BREATHl is stored in the A register (not shown) (SA7).

The CPU 130 looks up the breath data/after data conversion table 195 using the value in the A register as key data. The CPU 130 reads out after data corresponding to the value stored in the A register (i.e., after data corresponding to the current value of the breath data). The CPU 130 stores the readout value of the after data in the B register (SA8). The CPU 130 outputs the value of the B register as after data for instructing a tone volume of a musical tone in generation to the musical tone generator 160 (SA9). Thereafter, the flow returns to the main routine.

With the above-mentioned operation, the tone volume of a musical tone in generation changes according to the strength of the breath operation at the mouthpiece 115 (see FIGS. 7A and 7B).

If it is determined in step SA6 that the value of the breath data stored in the buffer BREATHl is smaller than the key OFF setup value, the flow advances to step SA10. In step SA10, the CPU 130 outputs key OFF data instructing to stop generation of a musical tone to the musical tone generator 160. In step SA11, the CPU sets the key ON flag to be "0".

Therefore, for example, when the operator quits or considerably weakens the breath operations at the mouthpiece 115, a musical tone in generation is stopped with a quick release term (see time $T_3$ in FIGS. 7A and 7B). Furthermore, the key ON flag is set to be "0" to indicate that no musical tone is generated.

Figure 9:
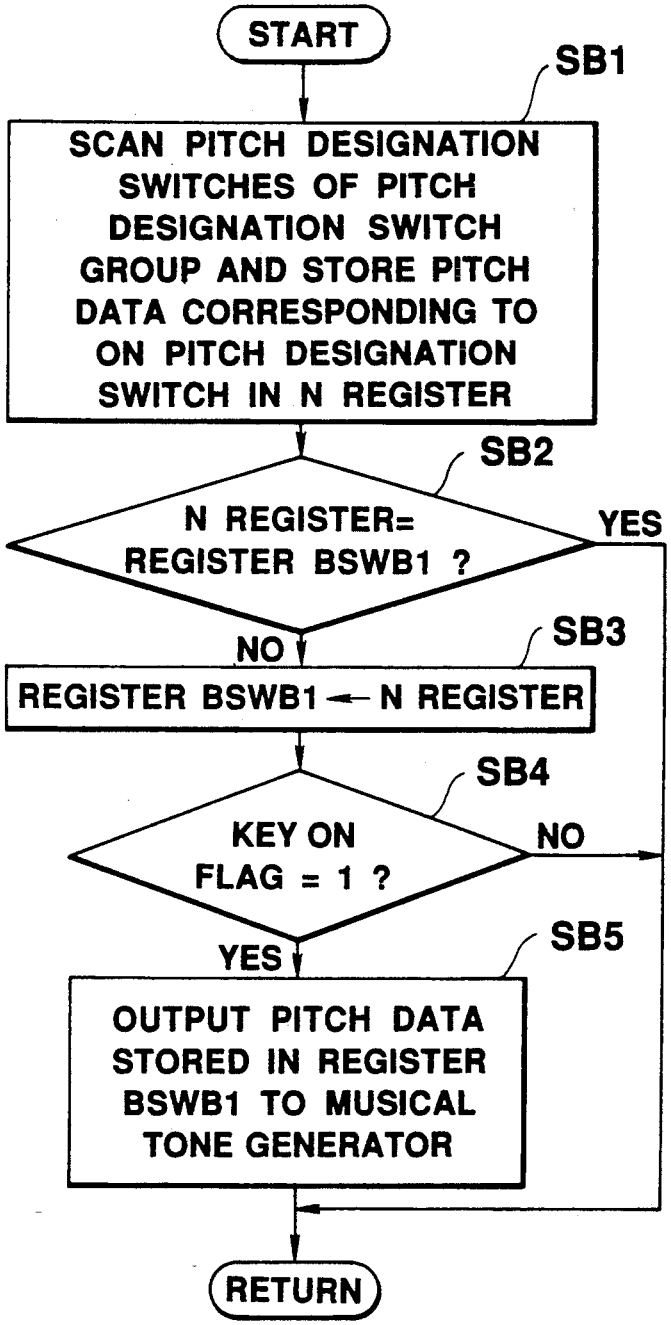
FIG. 9 is a flow chart for explaining generation processing of pitch data executed by a CPU.

FIG. 9 is a flow chart for explaining the operation of pitch setup processing executed by the CPU 130 in correspondence with the slide operation of the slide outer pipe 120.

The CPU 130 scans in turn the pitch designation switches 151 of the pitch designation switch group 150 from, e.g., a switch for a higher pitch to one for a lower pitch to detect an ON pitch designation switch 151. The CPU 130 inputs a detected switch signal to a memory 40. For this reason, pitch data corresponding to the ON pitch designation switch 151 is obtained according to change characteristics defined by a large number of pairs of data each consisting of position and pitch data, held in one of position/pitch conversion table selected from position/pitch conversion tables 140*a*, 140*b*, . . . by a table selection switch section 140A. The obtained pitch data is stored in the N register (SB1).

If none of the pitch designation switches 151 is ON, data indicating that no pitch designation is made (e.g., "0") is stored in the N register.

It is then checked if the value of the register BSWBl storing the previously designated pitch data is equal to the value of the V register storing the currently designated pitch data (SB2). If the values of the two registers are equal to each other, since there is no change in pitch designation, the flow immediately returns to the main routine.

If is determined in step SB2 that the values of the two registers are not equal to each other, since there is a change in pitch designation, the pitch data stored in the N register is stored in the register BSWBl (SB3). It is then checked if the key ON flag is "1", i.e., if a musical tone is being generated (SB4). If the key ON flag is "0", the flow immediately returns to the main routine.

However, if it is determined in step SB4 that the key ON flag is "1", i.e., a musical tone is being generated, the new pitch data stored in the register BSWBl is output to the musical tone generator 60 (SB5).

With the above-mentioned operation, when the operator slides the slide outer pipe 120 at time $T_2$ in FIG. 7A during generation of a musical tone having a predetermined pitch, a tone volume is maintained in correspondence with the strength of the breath operation at the mouthpiece 115, and only the pitch is changed to the new pitch. Therefore, when a pitch is continuously changed at half-note intervals or less, a glissando or portamento performance can be easily realized.

In the second embodiment, the inner pipe 116 is formed of the flexible conductive member 116*a*. However, the present invention is not limited to this. For example, the inner pipe 116 may be formed of a flexible resistive member, so that one end of the resistive member may be connected to a DC power source and the other end is grounded. With this structure, when a conductive element 151*a* is brought into contact with the resistive member, a voltage value which varies depending on the contacting conductive element 151*a* is output to the CPU 130. The CPU 130 can determine a pitch according to the voltage value.

THIRD EMBODIMENT

The third embodiment of the present invention will be described below.

Figure 10:
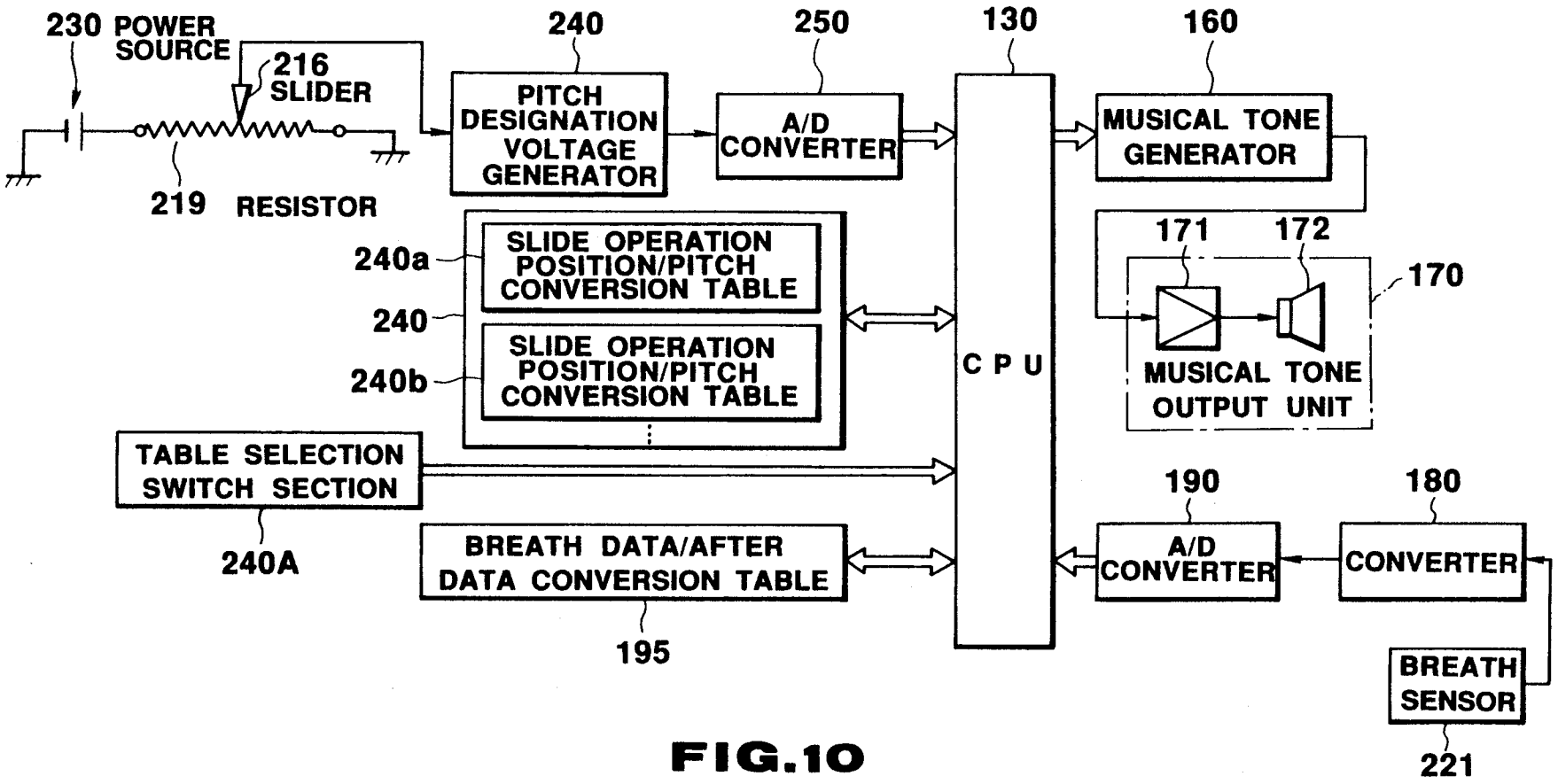
FIG. 10 is a block diagram showing a system configuration according to the third embodiment of the present invention.
Figure 11A:
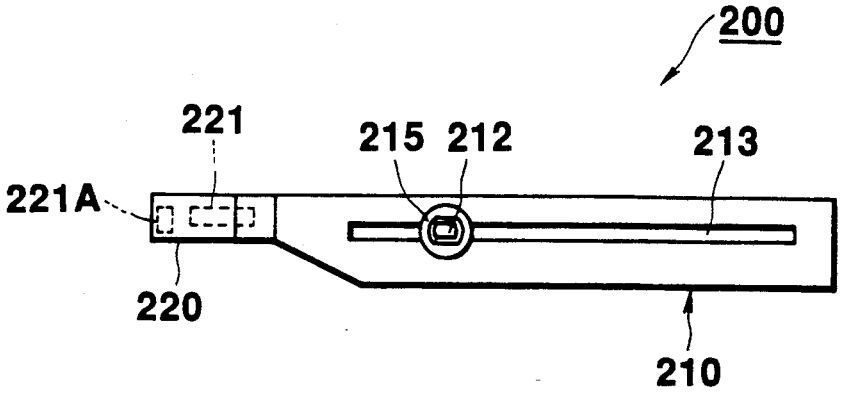
FIGS. 11A and 11B are a side view and a plan view of an electronic wind instrument of the third embodiment, respectively.
Figure 11B:
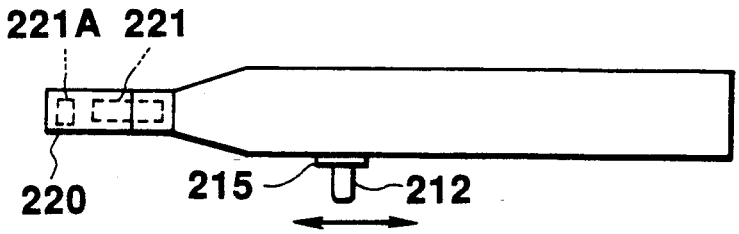

FIG. 10 is a block diagram showing a system configuration according to the third embodiment of the present invention. FIGS. 11A and 11B are respectively a side view and a plan view of an electronic wind instrument 200 of the third embodiment.

As shown in FIGS. 11A and 11B, the electronic wind instrument 200 comprises: a body 210, and a mouthpiece 220 inserted in a mouthpiece portion 211 of the body 210. A breath sensor 221 for detecting a flow state of air blown into the mouthpiece 220 is arranged in the mouthpiece 220, as shown in FIG. 11B. The body 210 has a cylindrical shape. As shown in FIG. 11A, an elongated hole 213 for allowing a sliding movement of a slide operation element 212 is formed on one side surface portion of the body 210.

Figure 11C:
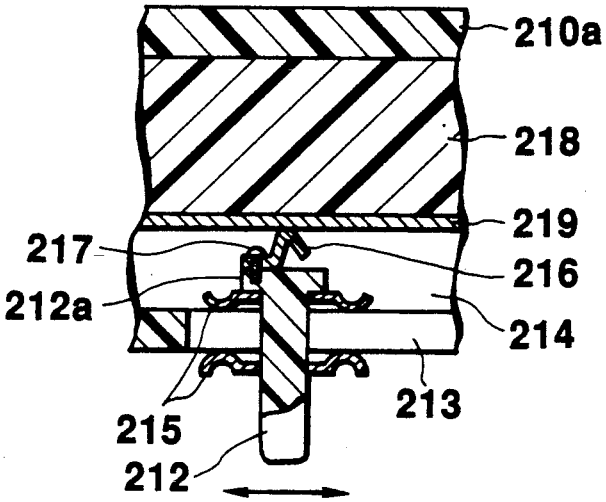
FIG. 11C is a sectional view showing a structure of a slide operation member.

FIG. 11C is a sectional view showing a detailed structure of the slide operation element 212.

As shown in FIG. 11C, a slider moving path 214 is defined inside the body 210 along the elongated hole 213. The slide operation element 212 is loosely clamped on two sides of the elongated hole 213 by springs 215. The slide operation element 212 has a bolt-like shape having a head portion 212*a* which is widened inside the slider moving path 214. A slider 216 is fixed to the head portion 212*a* of the slide operation element 212 by a screw 217. A support base 218 of an insulating member such as wood or plastic is fixed to an inner peripheral edge of a cylinder 210*a* as an outer shell portion of the body 210. An elongated resistive plate 219 is adhered on the surface of the support base 218 along the elongated hole 213.

FIG. 10 is a block diagram showing a system configuration of the electronic wind instrument 200 with the above structure. The same reference numerals in FIG. 10 denote the same circuit blocks as in FIG. 4, and a detailed description thereof will be omitted.

One end of the resistive plate 219 is connected to a DC power source 230, and the other end is grounded. The slider 216 is connected to a pitch designation voltage generator 240 for converting a voltage value across the contact point between the slider 216 and the resistive plate 219 and ground into a pitch designation voltage. The analog pitch designation voltage output from the pitch designation voltage generator 240 is supplied to an A/D converter 250. The A/D converter 250 converts the input analog signal into digital pitch designation data, and outputs it to a CPU 130.

When an operator slides the slide operation element 212, the slider 216 is slid to be interlocked with the slide operation element 212 while being in contact with the resistive plate 219. Therefore, the contact position between the slider 216 and the resistive plate 219 changes upon sliding of the slide operation element 212.

For this reason, when the operator slides the slide operation element 212, a voltage value applied to the pitch designation voltage generator 240 is continuously changed in accordance with the position of the slide operation element. The pitch designation voltage generator 240 converts the input voltage into a corresponding pitch designation voltage, and applies the converted voltage to the A/D converter 250. The A/D converter 250 converts the input analog pitch designation voltage into digital pitch designation data, and supplies the data to the CPU 130.

The CPU 130 supplies the pitch designation data to a memory 240. The pitch designation data is converted into corresponding pitch data in accordance with pitch change characteristics defined by a position/pitch conversion table selected from position/pitch conversion tables 240*a*, 240*b*, . . . by a table conversion switch section 240A.

Therefore, when the high-speed, high-precision A/D converter 250 is used, continuous pitch designation is allowed upon sliding of the slide operation element 212.

Contrary to this, a low-precision A/D converter 250 may be used to convert a continuous analog pitch designation voltage into a digital voltage value corresponding to scale notes, and the digital voltage value may be output to the CPU 130. With this arrangement, since dispersed digital voltages can correspond to scale pitches, a scale performance is allowed.

FOURTH EMBODIMENT

The fourth embodiment according to the present invention will be described below.

Figure 12:
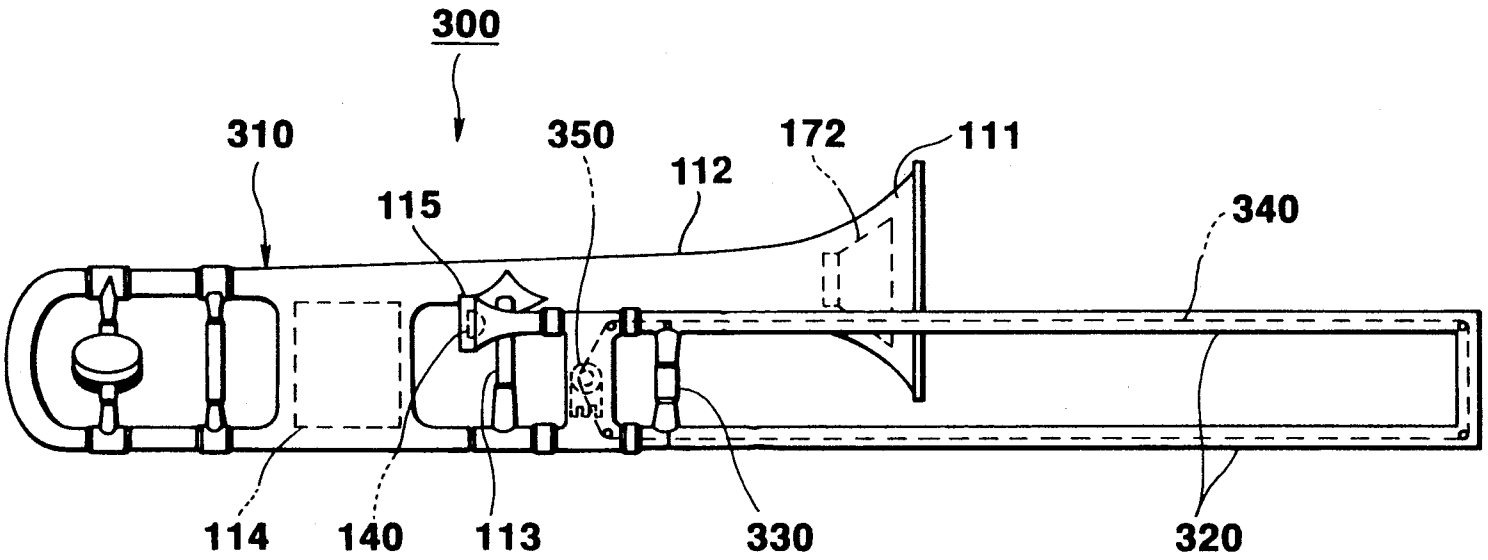
FIG. 12 is a side view showing the outer appearance of an electronic wind instrument according to the fourth embodiment of the present invention.

FIG. 12 shows an outer appearance of an electronic wind instrument 300 according to the fourth embodiment of the present invention. The same reference numerals in FIG. 12 denote the same parts as in FIG. 5, and a detailed description thereof will be omitted.

In FIG. 12, a U-shaped main outer pipe 320 is fixed to a body 310.

Figure 13:
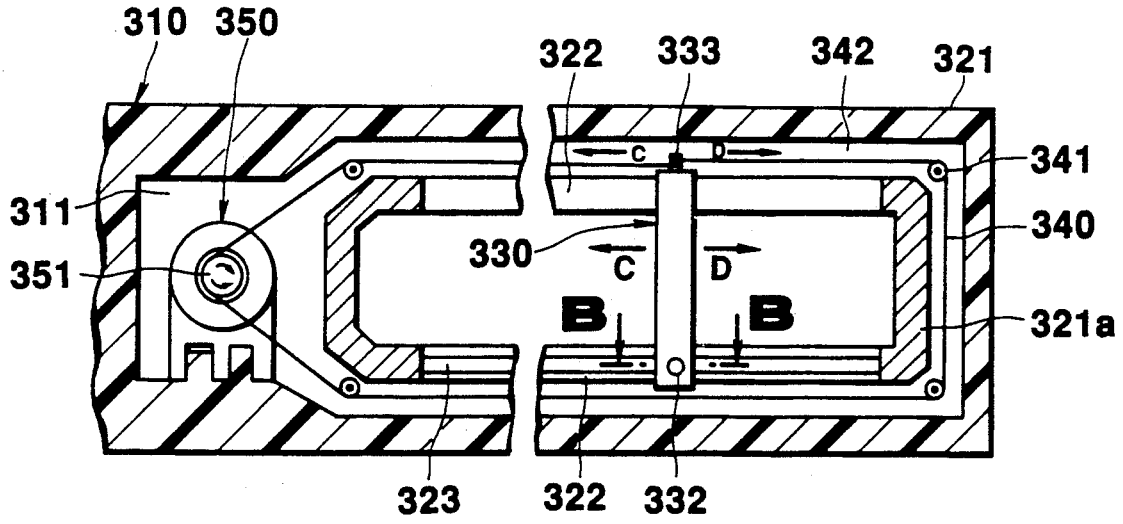
FIG. 13 is a longitudinal sectional view showing an internal structure near an outer main pipe, a main pipe, and a connecting portion of the outer main pipe.

FIG. 13 is a longitudinal sectional view of the main outer pipe 320.

A hollow portion 342 is defined by a peripheral wall 321 of the main outer pipe 320. Pivotal rotary slides 341 are arranged at four corners of the hollow portion 342. A rotary variable resistor 350 whose resistance is varied upon rotation of a rotational shaft 351 is fixed in a hollow portion 311 defined near the coupling portion between the body 310 and the main outer pipe 320. Slide elongated holes 322 are formed in a peripheral wall inner shell portion 321*a* as an inner shell of the peripheral wall 321. Ball slide grooves 323 are formed in the lower slide elongated groove 322 along its longitudinal direction.

Figure 14:
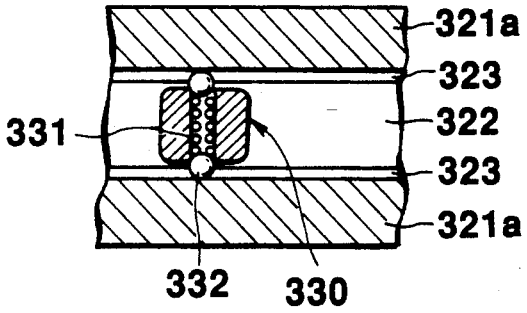
FIG. 14 is a sectional view of the slide operation member.

A slide operation portion 330 which is slidable along the slide elongated holes 322 is provided to the main outer pipe 320. FIG. 14 shows the structure of a one-end portion of the slide operation portion 330. FIG. 14 is a sectional view taken along a line B—B in FIG. 13. As shown in FIG. 14, the one-end portion comprises a spring 331, and balls 332 fitted in the corresponding ball slide grooves 323 by the biasing force of the spring 331. The one-end portion is slidably and loosely fitted in the lower slide elongated hole 322 (FIG. 13) by the spring 331 and the balls 332. A wire fixing shaft 333 projecting into the hollow portion 342 is provided at the upper distal end (FIG. 13) of the slide operation portion 330. The slide operation portion 330 can be smoothly moved since the balls 332 are in rolling contact with the ball slide grooves 323.

An endless wire 340 of a string having a very small degree of shrinkage is wound around the wire fixing shaft 333 of the slide operation portion 330, and is in contact with the rotary slides 341. In addition, the wire 340 is looped on the rotational shaft 351 of the rotary variable resistor 350. Since the wire 340 is wound around the wire fixing shaft 333, when the operator slides the slide operation portion, the wire 340 is moved in synchronism with the sliding operation. The movement of the wire 340 causes the rotational shaft 351 of the rotary variable resistor 350 to rotate. For example, when the slide operation portion 330 is slid in a D direction in FIG. 13, the rotational shaft 351 is rotated clockwise in FIG. 13, and the resistance of the rotary variable resistor 350 is decreased. On the other hand, when the slide operation portion 330 is slid in a C direction in FIG. 13, the rotational shaft 351 is rotated counterclockwise in FIG. 13, thus increasing the resistance of the rotary variable resistor 350.

Therefore, the resistance of the variable resistor 350 is changed in accordance with the slide operation of the slide operation portion 330. A change in resistance is extracted as a change in voltage, and pitch data can be generated on the basis of the change in pitch.

Figure 15:
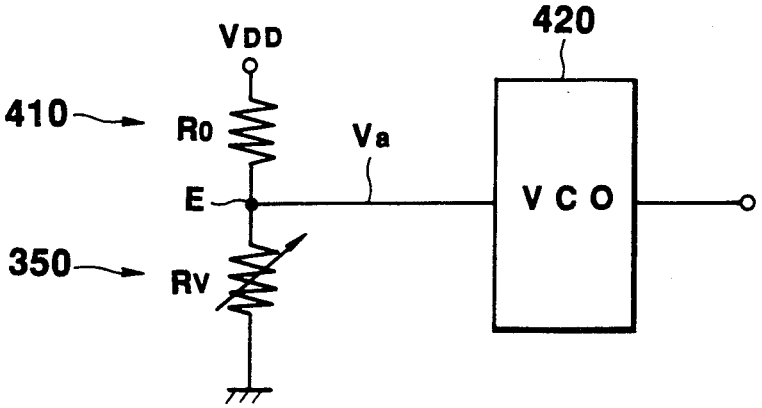
FIG. 15 is a circuit diagram showing a circuit for generating a musical tone having an arbitrary pitch according to a change in resistance of a rotary variable resistor.

FIG. 15 shows a circuit for generating a pitch on the basis of a change in resistance of the rotary variable resistor 350 described above.

The circuit shown in FIG. 15 is constituted by a series circuit of the rotary variable resistor 350 and a resistor 410 having a fixed resistance $R_0$. A DC voltage $V_{DD}$ is applied from a DC power source to one end of the resistor 410, and one end of the rotary variable resistor 350 is grounded. With this arrangement, a change in resistance $R_V$ of the rotary variable resistor 350 which changes according to sliding of the slide operation portion 330 is converted to a change in voltage $V_a$ at a connecting node E between the rotary variable resistor 350 and the resistor 410. The voltage $V_a$ is applied to a VCO (Voltage Controlled Oscillator) 420. With the arrangement shown in FIG. 15, an oscillation frequency of a waveform signal output from the VCO 420 is changed upon sliding of the slide operation portion 330.

Therefore, when the VCO 420 is designed so that the oscillation frequency of the VCO 420 corresponds to a frequency of a predetermined pitch, a musical tone having a pitch corresponding to a position of the slide operation portion 330 can be obtained. Since the resistance $R_V$ of the rotary variable resistor 350 is continuously changed, the oscillation frequency of the VCO 420 is also continuously changed. Therefore, not only a glissando performance but also portamento and vibrato performances are allowed.

In the second to fourth embodiments, the position of a slidable member is detected by a resistive plate and switches (second embodiment) or is detected based on a change in resistance of a variable resistor (third and fourth embodiments). In addition to the above detection methods, a slide operation position may be detected by a photosensor for detecting a light amount, an ultrasonic sensor, or the like.

In the above embodiment, the strength (a flow state of air blown from the mouthpiece) of a breath operation for blowing a breath into the mouthpiece 115 is detected to control generation of a musical tone or to control a tone volume of the musical tone. The strength of not only the breath operation for blowing a breath but also a breath operation for taking a breath (a flow state of air flowing out from the mouthpiece 220) may be detected. In addition, in order to detect a strength of a lip operation for biting the mouthpiece 220 as shown in FIGS. 11A and 11B, a lip sensor 221A may be arranged, and generation of a musical tone or a tone volume of the musical tone may be controlled on the basis of sense data output from the sensor 221A.

In addition, a flow state of air flowing out from an extendable member for supplying air by extending/retracting a bellows like an accordion may be detected, and musical tone control may be performed based on the air flow state. A flow state of a wind (air) flowing out from a member for supplying a wind like a bellows may be detected, and musical tone control may be performed on the basis of the air flow state.

Additional advantages and modifications will readily occur to those skilled in the art. Therefore, the invention in its broader aspects is not limited to the specific details, representative devices, and illustrated examples shown and described. Accordingly, departures may be made from such details without departing from the spirit or scope of the general inventive concept as defined by the appended claim and their equivalents.

What is claimed is:

1. A pitch data output apparatus, comprising:

a first member and a second member which can be relatively moved to approach and separate from each other;

distance measurement means for measuring a relative distance between said first and said second members;

means for storing a plurality of conversion tables each defining a different conversion characteristic, each characteristic representing a function for converting said relative distance into pitch data;

selection means for selecting a desired conversion table from among said plurality of conversion tables to obtain a particular conversion characteristic;

conversion means for converting the relative distance measured by said distance measurement means into corresponding pitch data in accordance with the particular conversion characteristic obtained by said selection means from a plurality of different conversion characteristics; and pitch data output means for outputting the pitch data converted by said conversion means;

said distance measuring means comprising:

transmission means, arranged in at least one of said first and said second members, for intermittently transmitting one of sound and electromagnetic waves;

reception means, arranged in at least one of said first and second members, for receiving one of the sound and electromagnetic waves transmitted by said transmission means;

time measurement means for measuring a time unit one of the sound and electromagnetic waves transmitted from said transmission means is received by said reception means; and distance detection means for obtaining the relative distance between said first and said second members on the basis of the time measured by said time measurement means; and said transmission means and said reception means being arranged in one of said first and said second members, the other one of said first and second members comprising reflection means for reflecting one of the sound and electromagnetic waves transmitted from said transmission means, and said reception means being arranged to receive one of the sound and the electromagnetic waves reflected by said reflection means.

2. An electronic musical instrument, comprising:

a first member and a second member which can be relatively moved to approach and separate from each other;

distance measurement means for measuring a relative distance between said first and said second members;

selection means for selecting a conversion characteristic from a plurality of conversion characteristics, said conversion characteristic defining a function for converting said relative distance into pitch data;

conversion means for converting the relative distance measured by said distance measurement means into corresponding pitch data in accordance with the conversion characteristic selected by said selection means from the plurality of conversion characteristics;

pitch data output means for outputting the pitch data converted by said conversion means;

air flow state detection means for detecting an air flow state; and means, responsive to the air flow state detected by said air flow state detection means, for outputting a signal for instructing generation of a musical tone having a pitch corresponding to the pitch data output from said pitch data output means.

3. An instrument according to claim 2, wherein said air flow state detection means comprises a mouthpiece, and means for detecting one of a flow state of air flowing into said mouthpiece and a flow state of air flowing out from said mouthpiece.

4. An electronic musical instrument, comprising:

a first member and a second member which can be relatively moved to approach and separate from each other;

distance measurement means for measuring a relative distance between said first and said second members;

selection means for selecting a specific conversion characteristic from a plurality of conversion characteristics, said conversion characteristic defining a function for converting said relative distance into pitch data;

conversion means for converting the relative distance measured by said distance measurement means into corresponding pitch data in accordance with the conversion characteristics selected by said selection means;

pitch data output means for outputting the pitch data converted by said conversion means;

bite pressure detection means for detecting a bite pressure; and means, responsive to the bite pressure detected by said bite pressure detection means, for outputting a signal for instructing generation of a musical tone having a pitch corresponding to the pitch data output from said pitch data output means.

5. A pitch data output apparatus, comprising:

a first movable member and a second movable member arranged in contact with one another for relative movement over a determined path;

relative position detection means for detecting a position of said second movable member relative to said first movable member;

means for storing a plurality of conversion tables each defining a different conversion characteristic, each characteristic representing a function for converting said relative position into pitch data;

selection means for selecting a desired conversion table from among said plurality of said conversion tables to obtain a particular conversion characteristic;

said first movable member comprising a cylindrical flexible member formed of a conductive material, and a plurality of conductors arranged at predetermined intervals in said flexible member along a longitudinal direction of said flexible member;

said second movable member comprising a cylindrical member for covering said first movable member, and a projection member for, when said cylindrical member and said flexible member are moved relative to each other, bringing said flexible member into contact with one of said conductors; and said relative position detection means detecting the position of said flexible member relative to said cylindrical member on the basis of the conductor which contacts a portion of said flexible member pressed by said projection member.

6. An electronic musical instrument, comprising:

a first movable member and a second movable member arranged in contact with one another for relative movement over a determined path;

relative position detection means for detecting a position of said second movable member relative to said first movable member;

means for storing a plurality of conversion tables each defining a different conversion characteristic, each characteristic representing a function for converting said relative position into pitch data;

selection means for selecting a desired conversion table from among said plurality of conversion tables to obtain a particular conversion characteristic;

conversion means for converting the relative position detected by said relative position detection means into corresponding pitch data in accordance with the particular conversion characteristic obtained by said selection means;

pitch data output means for outputting the pitch data converted by said conversion means;

air flow state detection means for detecting an air flow state; and means, responsive to the air flow state detected by said air flow state detection means, for outputting a signal for instructing generation of a musical tone having a pitch corresponding to the pitch data output from said pitch data output means; and said air flow state detection means comprising a mouthpiece, and means for detecting one of a flow state of air flowing into said mouthpiece and a flow state of air flowing out from said mouthpiece.

7. An electronic musical instrument, comprising:

a first movable member and a second movable member arranged in contact with one another for relative movement over a determined path;

relative position detection means for detecting a position of said second movable member relative to said first movable member;

selection means for selecting one of a plurality of conversion characteristics each of which characteristics defines a function for converting the detected relative position into pitch data;

conversion means for converting the relative position detected by said relative position detection means into corresponding pitch data in accordance with the conversion characteristics selected by said selection means;

pitch data output means for outputting the pitch data converted by said conversion means;

bite pressure detection means for detecting a bite pressure; and means, responsive to the bite pressure detected by said bite pressure detection means, for outputting a signal for instructing generation of a musical tone having a pitch corresponding to the pitch data output from said pitch data output means.

8. A pitch data output apparatus comprising:

a first movable member and a second movable member arranged in contact with one another for relative movement over a determined path;

said first member comprising a cylindrical flexible member formed of a conductive material, and a plurality of conductors arranged at predetermined intervals in said flexible member along a longitudinal direction of said flexible member;

said second member comprising a cylindrical member for covering said first member, and a projection member for, when said cylindrical member and said flexible member are moved relative to each other, bringing said flexible member into contact with one of said conductors;

relative position detection means for detecting a position of said flexible member relative to said cylindrical member on the basis of the conductor which contacts a portion of said flexible member pressed by said projection member;

conversion means for converting the relative position detected by said relative position detection means into corresponding pitch data; and pitch data output means for outputting the pitch data converted by said conversion means.

9. An apparatus according to claim 8, wherein said apparatus comprises selection means coupled to said conversion means, for selecting one of a plurality of conversion characteristics which determine functions for converting the relative position into pitch data.

10. A pitch data output apparatus, comprising:

a first movable member and a second movable member arranged in contact with one another for relative movement over a determined path;

relative position detection means for detecting a position of said second movable member relative to said first movable member;

selection means for selecting one of a plurality of conversion characteristics each of which characteristics defines a function for converting the detected relative position into pitch data;

wherein said first movable member comprises a cylindrical flexible member formed of a conductive material, and a plurality of conductors arranged at predetermined intervals in said flexible member along a longitudinal direction of said flexible member, said second movable member comprises a cylindrical member for covering said first movable member, and a projection member for, when said cylindrical member and said flexible member are moved relative to each other, bringing said flexible member into contact with one of said conductors, and said relative position detection means detects the position of said flexible member relative to said cylindrical member on the basis of the conductor which contacts a portion of said flexible member pressed by said projection member.

11. An electronic musical instrument, comprising:

a first movable member and a second movable member arranged in contact with one another for relative movement over a determined path;

relative position detection means for detecting a position of said movable member relative to said first movable member;

selection means for selecting one of a plurality of conversion characteristics each of which characteristics defines a function for converting the detected relative position into pitch data;

conversion means for converting relative position detected by said relative position detection means into corresponding pitch data in accordance with the conversion characteristics selected by said selection means;

pitch data output means for outputting the pitch data converted by said conversion means;

air flow state detection means for detecting an air flow state; and means, responsive to the air flow state detected by said air flow state detection means, for outputting a signal for instructing generation of a musical tone having a pitch corresponding to the pitch data output from said pitch data output means; and wherein said air flow state detection means comprises a mouthpiece, and means for detecting one of a flow state of air flowing into said mouthpiece and a flow state of air flowing out from said mouthpiece.

* * * * *